US007619641B2

(12) United States Patent
Shih et al.

(10) Patent No.: US 7,619,641 B2
(45) Date of Patent: Nov. 17, 2009

(54) COLOR DISPLAY

(75) Inventors: Ming-Chia Shih, Tainan (TW); Ying-Hao Hsu, Tainan (TW)

(73) Assignee: Chi Mei Optoelectronics Corp. (TW)

( * ) Notice: Subject to any disclaimer, the term of this patent is extended or adjusted under 35 U.S.C. 154(b) by 638 days.

(21) Appl. No.: 11/262,324

(22) Filed: Oct. 28, 2005

(65) Prior Publication Data

US 2006/0103615 A1 May 18, 2006

(30) Foreign Application Priority Data

Oct. 29, 2004 (TW) ..... 93132929 A

(51) Int. Cl.
*G09G 5/02* (2006.01)

(52) U.S. Cl. ..... 345/694; 345/695

(58) Field of Classification Search ..... 345/60, 345/88, 96, 100, 694, 695; 382/239, 443
See application file for complete search history.

(56) References Cited

U.S. PATENT DOCUMENTS 5,717,474 A 2/1998 Sarma
5,847,688 A 12/1998 Ohi et al.
6,002,385 A * 12/1999 Silverbrook ..... 345/100
2002/0028996 A1* 3/2002 Uehara ..... 600/443
2002/0090140 A1* 7/2002 Thirsk ..... 382/239
2002/0113921 A1* 8/2002 Jiang et al. ..... 349/96
2002/0149598 A1 10/2002 Greier et al.
2002/0190925 A1* 12/2002 Awamoto et al. ..... 345/60
2003/0128179 A1* 7/2003 Credelle ..... 345/88
2004/0051724 A1* 3/2004 Elliott et al. ..... 345/694
2006/0170712 A1* 8/2006 Miller et al. ..... 345/695
2006/0202927 A1* 9/2006 Lee ..... 345/88

FOREIGN PATENT DOCUMENTS

CN 2494010 Y 5/2002
WO WO2004021323 3/2004

* cited by examiner

*Primary Examiner*—Amare Mengistu
*Assistant Examiner*—Premal Patel
(74) *Attorney, Agent, or Firm*—Trop Pruner & Hu, P.C.

(57) ABSTRACT

A color display comprises a plurality of first pixel groups and a plurality of second pixel groups. Each first pixel group includes three color pixels and each color pixel has at least two subpixels. Each first pixel group has a first arrangement of subpixels. The first pixel groups and the second pixel groups are alternately disposed in at least one direction. Each second pixel group includes three color pixels and each color pixel has at least two subpixels. Each second pixel group has a second arrangement of subpixels. The second arrangement is different from the first arrangement.

34 Claims, 10 Drawing Sheets

COLOR DISPLAY

TECHNICAL FIELD

The invention relates to a color display.

BACKGROUND

Due to the difference of the retardation caused by different angles of light passing through a liquid crystal layer of a liquid crystal display, the light transmittance of a liquid crystal display when viewing from the front is different from the light transmittance of the liquid crystal display when viewing from the side. Hence, the refractive index of the light will change according to different observation angles and result in different transmittance and different brightness when viewing from different angles. Additionally, a color distortion phenomenon will result when different colors of light (such as red light, green light, and blue light) are combined at different brightness.

FIG. 1 shows an arrangement of subpixels of a color display 10 according to the prior art that attempts to address some of the issues noted above. As shown in FIG. 1, a conventional color display 10 (such as a liquid crystal display) includes a plurality of pixel groups 11 and 12, in which the pixel groups are arranged in a matrix. Each pixel group includes a red pixel, a green pixel, and a blue pixel. Taking pixel group 11 as an example, the red pixel includes a red first subpixel 111 and a red second subpixel 112, the green pixel includes a green third subpixel 113 and a green fourth subpixel 114, and the blue pixel includes a blue fifth subpixel 115 and a blue sixth subpixel 116.

The two subpixels of each color pixel are driven by bright state signals and dark state signals, such that the subpixels will combine to form a gray scale value and display a color, thereby improving the overall viewing angle of the display and color distortion generated during larger viewing angles. As shown in FIG. 2, the red first subpixel 111 is driven by a bright state red (R1) display signal and the red second subpixel 112 is driven by a dark state red (R1) display signal (slanted lines shown in FIG. 2 indicate that they are driven by a dark state display signal). The red first subpixel 111 and the red second subpixel 112 combine to form the red color (R1) of the first pixel group 11 for improving the color distortion and viewing angle of the red color of pixel group 11. Similarly, the green pixel and the blue pixel within the first pixel group 11 are driven by the same method to improve the color distortion and viewing angle of the first pixel group 11.

At the same gray scale value, each color will produce a color distortion due to different front view normalized transmittance and side view normalized transmittance. Additionally, when the gray scale value approaches 0 or 255, the difference between the front view normalized transmittance and the side view normalized transmittance will decrease and approaches 0%. This feature of small or zero difference between front view normalized transmittance and side view normalized transmittance as gray scale values approach 0 and 255 can be used in conjunction with the arrangement of FIG. 1 and the bright state/dark state signal driving technique of FIG. 2 to achieve less color distortion at different viewing angles. For example, using the arrangement of FIGS. 1 and 2, to achieve an original gray scale value of 128 for the blue pixel, a dark state signal (such as a dark state gray scale value) can be selected to be zero, and a bright state signal (such as a bright state gray scale value) can be selected to be 190, such that the signals are utilized as a group of calibrating gray scale values (including the dark state gray scale value and the bright state gray scale value stated above) to obtain the original gray scale value, in which the difference between the front view normalized transmittance and the side view normalized transmittance of the calibrating gray scale values is less than the difference between the front view normalized transmittance and the side view normalized transmittance of the original gray scale value 128. Consequently, the users are able to perceive equal brightness as the original gray scale value while viewing the liquid crystal display from the front and from the side and at the same time, improve problems such as color distortion by utilizing the calibrated gray scale values.

Nevertheless, since the subpixels driven by the bright state signal are collectively gathered in the first row and the subpixels driven by the dark state signal are gathered in the second row of respective pixel groups in FIG. 2, a resultant uneven brightness phenomenon may still result in a negative viewing effect.

DETAILED DESCRIPTION

Figure 7:
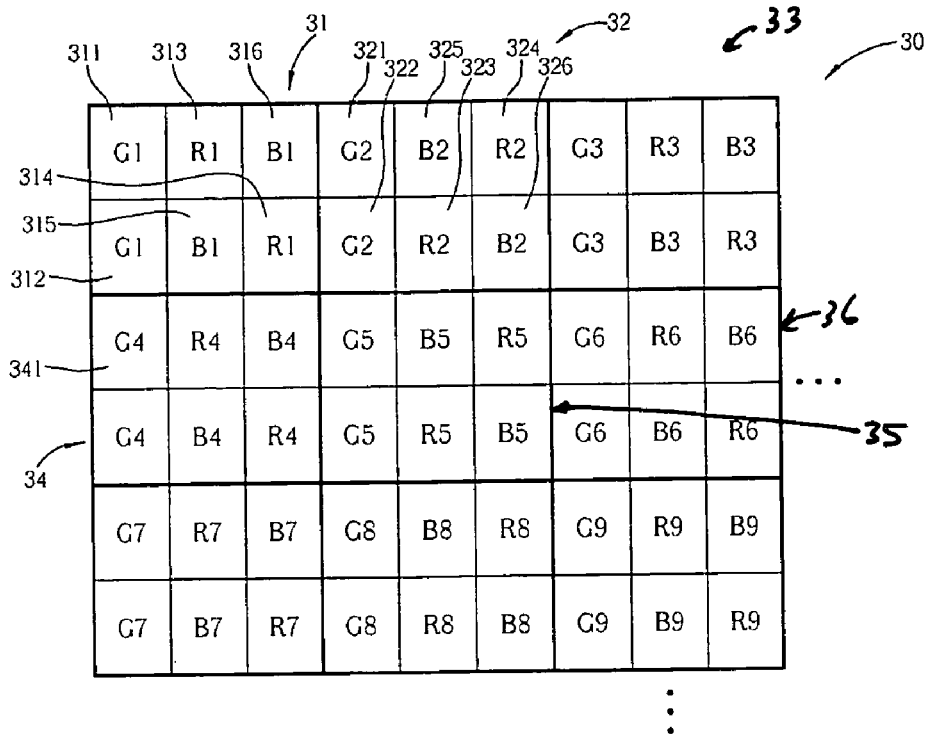
FIG. 7 illustrates a subpixel arrangement of pixel groups of a color display according to a first embodiment of the present invention.

FIG. 7 shows a pixel arrangement of a color display 30 (e.g., a liquid crystal display) according to a first embodiment of the present invention. The color display 30 includes a plurality of pixel groups 31 and 32 (as well as other pixel groups), in which each of the pixel groups 31 and 32 is arranged in a matrix, and each of the pixel groups includes a first color pixel, a second color pixel, and a third color pixel. Utilizing the first pixel group 31 as an example, the first color pixel is green, the second color pixel is red, and the third color pixel is blue. However, in other embodiments, other colors can be used. The green pixel includes a green first subpixel 311 and a green second subpixel 312, the red pixel includes a red third subpixel 313 and a red fourth subpixel 314, and the blue pixel includes a blue fifth subpixel 315 and a blue sixth subpixel 316.

The green first subpixel 311 and the green second pixel 312 are disposed adjacent to each other in the first column of the first pixel group 31, the red third subpixel 313 and the blue fifth subpixel 315 are disposed adjacent to each other in the second column of the first pixel group 31, and the red fourth subpixel 314 and the blue sixth subpixel 316 are disposed adjacent to each other in the third column of the first pixel group 31.

The subpixels of the first pixel group 31 and the second pixel group 32 are arranged in two rows and three columns, in a matrix. Additionally, the subpixels of the first pixel group 31 and the second pixel group 32 are arranged according to the following rule: the first subpixel and the second subpixel are disposed in the first column, the third subpixel and the fifth subpixel are disposed in the second column, and the fourth subpixel and the sixth subpixel are disposed in the third column.

As depicted in FIG. 7, an array or matrix of pixel groups is provided, where the array includes plural pixel group rows (along the horizontal direction in FIG. 7) and plural pixel group columns (along the vertical direction in FIG. 7). Within each pixel group, an array or matrix of subpixel rows and columns is provided.

In accordance with some embodiments, the arrangement (second arrangement) of the subpixels of the second pixel group 32 is different from the arrangement (first arrangement) of the subpixels of the first pixel group 31. In the first arrangement, the green first subpixel 311 of the first pixel group 31 is disposed in the first row and first column of the first pixel group 31, the green second subpixel 312 of the first pixel group 31 is disposed in the second row and first column of the first pixel group 31, the red third subpixel 313 of the first pixel group 31 is disposed in the first row and second column of the first pixel group 31, the blue fifth subpixel 315 of the first pixel group 31 is disposed in the second row and second column of the first pixel group 31, the red fourth subpixel 314 of the first pixel group 31 is disposed in the second row and third column of the first pixel group 31, and the blue sixth subpixel 316 of the first pixel group 31 is disposed in the first row and third column of the first pixel group.

The third pixel group 33 along the horizontal direction in the first pixel group row has the same arrangement (first arrangement) as the first pixel group 31. Although not shown, the fourth pixel group along the horizontal direction has the same arrangement (second arrangement) as the second pixel group 32. Thus, pixel groups having the first arrangement are alternately arranged with pixel groups having the second arrangement at least along the horizontal direction. The alternating pattern of pixel groups having different arrangements is repeated in the remaining pixel group rows.

The arrangement of the subpixels of the second pixel group 32 is as follows: the green first subpixel 321 of the second pixel group 32 is disposed in the first row and first column of the second pixel group 32, the green second subpixel 322 of the second pixel group 32 is disposed in the second row and first column of the second pixel group 32, the red third subpixel 323 of the second pixel group 32 is disposed in the second row and second column of the second pixel group 32, the blue fifth subpixel 325 of the second pixel group 32 is disposed in the first row and second column of the second pixel group 32, the red fourth subpixel 324 of the second pixel group 32 is disposed in the first row and third column of the second pixel group 32, and the blue sixth subpixel 326 of the second pixel group 32 is disposed in the second row and third column of the second pixel group 32.

Hence, the difference between the second arrangement of the subpixels of the second pixel group 32 and the first arrangement of the subpixels of the first pixel group 32 lies in the fact that the arrangement of the red and blue subpixels within the second and third column of the second pixel group 32 is opposite to the arrangement of the red and blue subpixels within the second and third column of the first pixel group 32.

To achieve a wider viewing angle with lower color distortion for the color display 30, the two subpixels of each color pixel are driven respectively to a bright state signal and a dark state signal, where the gray scales of the bright and dark state signals are selected to achieve an input gray scale value (that is between the bright state and dark state gray scale values). The bright and dark state gray scale values are closer to the 255 and 0 gray scale values so that the difference between the front view transmittance luminance and the side view transmittance luminance is reduced.

Figure 3:
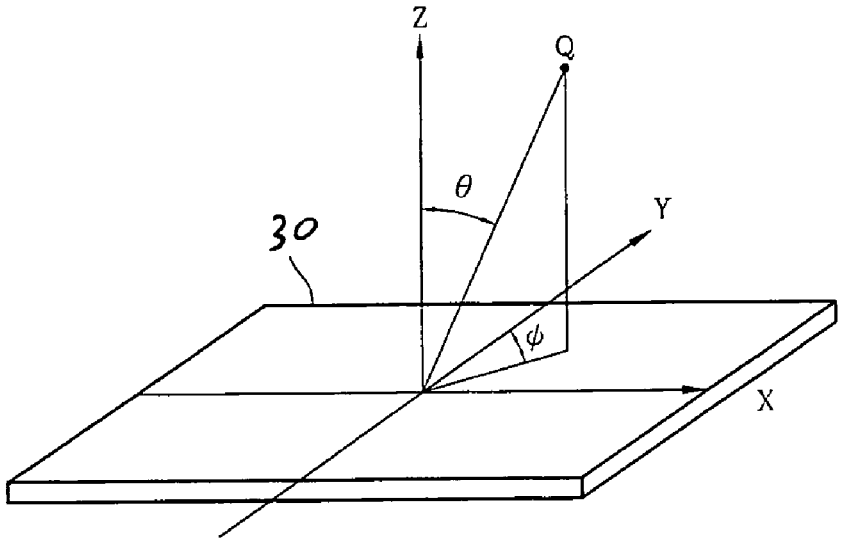
FIG. 3 is a graph showing the corresponding position of a user while viewing a color display from point Q.
Figure 4:
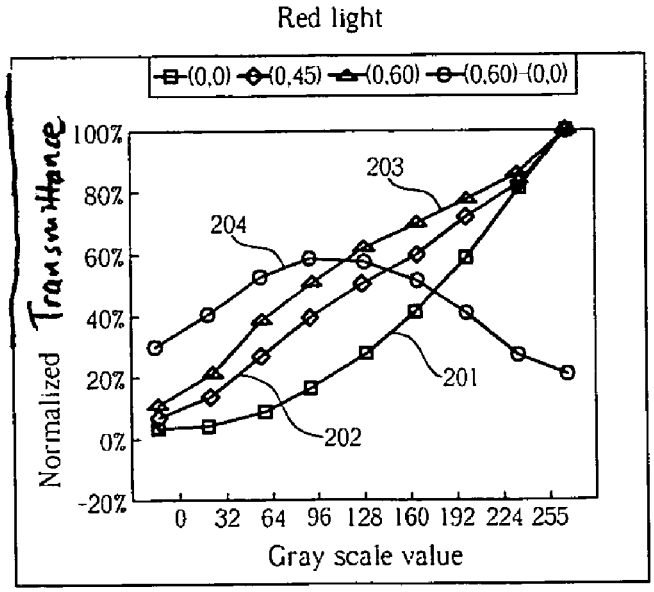
FIG. 4 through FIG. 6 are graphs showing the relationship between gray scale values and normalized transmittance of red light, green light, and blue light at different viewing angles.
Figure 5:
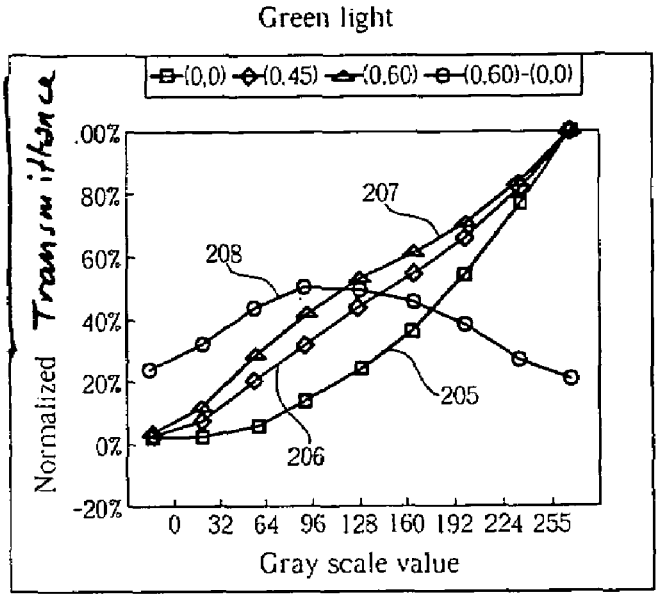
Figure 6:
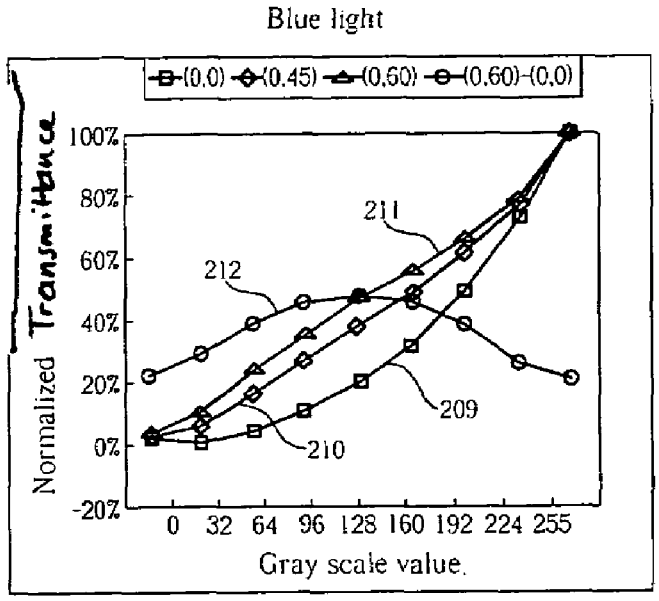

In general, the degree of color distortion generated in a liquid crystal display is different when each color red, green, and blue is at different gray scale values. FIG. 3 is a perspective diagram showing the corresponding position of a user at point Q while observing the liquid crystal display 30, and FIG. 4 through FIG. 6 are graphs showing the relationship between the gray scale value and normalized transmittance of red light, green light, and blue light at different viewing angles. For example, if the gray scale value of the pixels is between 0 and 255, the front view normalized transmission ratio of any gray scale value is the corresponding front view transmittance of the gray scale value divided by a maximum gray scale value (such as 255 for a normally black liquid crystal display), and the side view normalized transmittance of any gray scale value is the corresponding side view transmittance of the gray scale value divided by a maximum side view gray scale value (i.e. such as gray scale value 255).

As shown in FIG. 3, suppose the included angle between the line from the point Q to the center of the liquid crystal display 30 and the z-axis of the vector normal of the liquid crystal display 30 is θ degrees, and the angle between the line from the projecting point of the point Q to the center of the liquid crystal display 30 and the x-axis is ψ degrees, FIG. 4 through FIG. 6 depict a relationship between the gray scale values and the normalized transmittance when the angle (θ, ψ) equals (0, 0), (0, 45), and (0, 60) and the difference of the normalized transmittance between the angle (0, 60) and (0, 0).

As shown in FIG. 5, for green light, the curve 205 indicates the relationship between the gray scale value and the normalized transmittance when (θ, ψ) equals (0, 0); the curve 206 indicates the relationship between the gray scale value and the normalized transmittance when (θ, ψ) equals (0, 45); the curve 207 indicates the relationship between the gray scale value and the normalized transmittance when (θ, ψ) equals (0, 60); and the curve 208 indicates the relationship between the difference of the normalized transmittance of (0, 60) and (0, 0). When the angle (θ, ψ) equals (0, 0), it indicates that a user is viewing the liquid crystal display 30 from the front, and when the angle (θ, ψ) equals (0, 45) or (0, 60), it indicates that the user is viewing the liquid crystal display from the side at a 45 degree angle or at a 60 degree angle. In FIG. 4, curves 201, 202, 203, and 204 indicate relationships between gray scale values and normalized transmittance for red light similar to curves 205, 206, 208, and 210 in FIG. 5. In FIG. 6, curves 209, 210, 211, and 212 indicate relationships between gray scale values and normalized transmittance for blue light similar to the curves 205, 206, 207, and 208 in FIG. 5.

Figure 8:
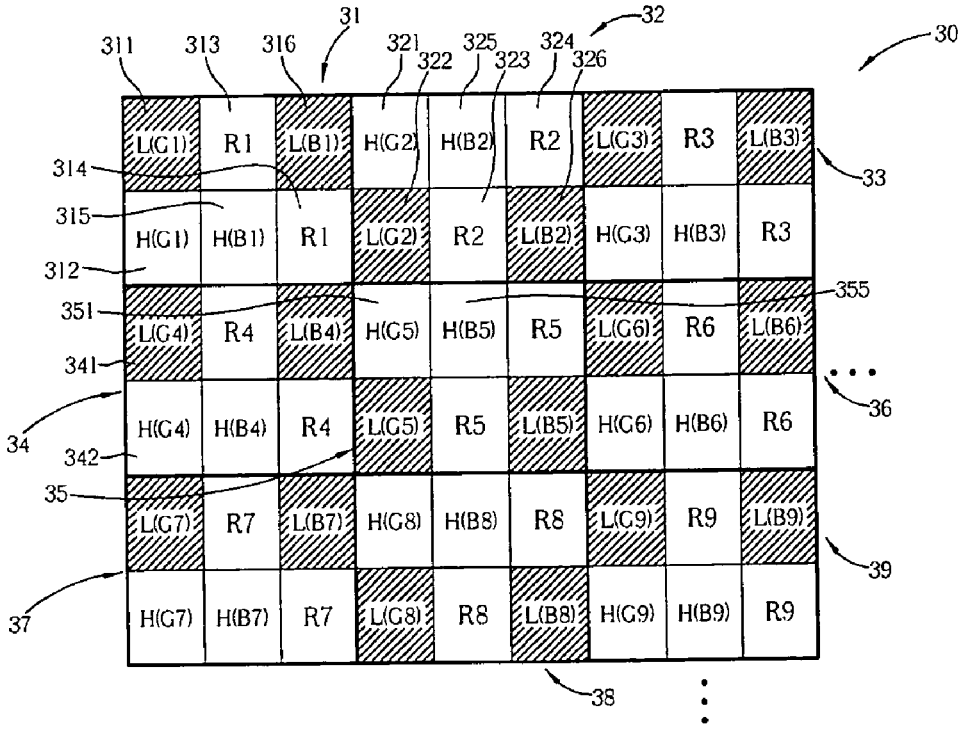
FIG. 8 illustrates a first driving mode to drive subpixel signals to the color display according to the first embodiment.

FIG. 8 shows how the subpixels of the pixel groups are driven utilizing corresponding bright state signals and dark state signals (dark state signals represented by slanted lines). The display signals of the subpixels of the first pixel group 31 and the second pixel group 32 are explained as follows: the green first subpixel 311 of the first pixel group 31 is driven by a green first dark state signal, and the green second subpixel 312 of the first pixel group 31 is driven by a green first bright state signal, and the green first subpixel 311 and the green second subpixel 312 combine to form the green color (G1) of the first pixel group 31. In other words, the gray scale value corresponding to the green bright state signal, and the gray scale value corresponding to the green dark state signal together combine to form the gray scale value for the green color (G1) pixel.

Since different viewing angles corresponding to red color generate less color distortion, both the red third subpixel 313 and the red fourth subpixel 314 of the first pixel group 31 are driven by an original red first display signal, and no red bright state signal or dark state signal are involved for driving the subpixels. Additionally, the blue fifth subpixel 315 of the first pixel group 31 is driven by a first blue bright state signal, the blue sixth subpixel 316 of the first pixel group 31 is driven by a first blue dark state signal, and the blue fifth subpixel 315 and the blue sixth subpixel 316 combine to form the blue color (B1) of the first pixel group 31.

The green first subpixel 321 of the second pixel group 32 is driven by a second green bright state signal, the green second subpixel 322 of the second pixel group 32 is driven by a second green dark state signal, and the green first subpixel 321 and the green second subpixel 322 combine to form the green color (G2) of the second pixel group 32. Since different viewing angles corresponding to red color generate less color distortion, both the red third subpixel 323 and the red fourth subpixel 324 of the second pixel group 32 are driven by an original red display signal, and no red bright state signal or dark state signal are involved for driving the subpixels. Additionally, the blue fifth subpixel 325 of the second pixel group 32 is driven by a second blue bright state signal, the blue sixth subpixel 326 of the second pixel group 32 is driven by a second blue dark state signal, and the blue fifth subpixel 325 and the blue sixth subpixel 326 combine to form the blue color (B2) of the second pixel group 32.

Figure 1:
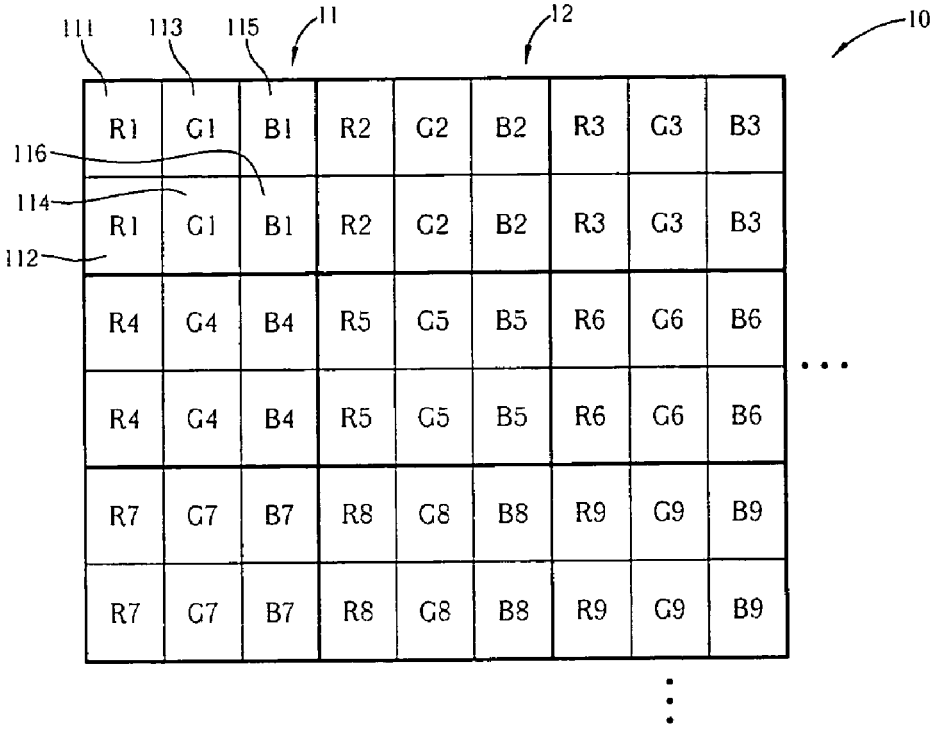
Fig. 1 Prior art
FIG. 1 illustrates a conventional arrangement of subpixels in pixel groups of a conventional color display.
Figure 2:
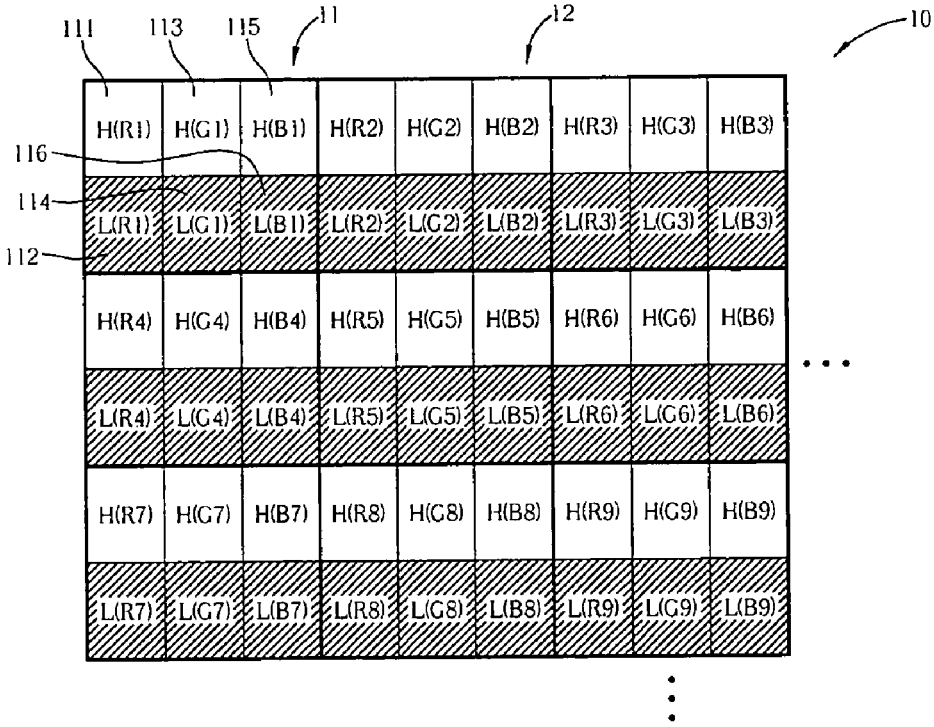
Fig. 2 Prior art
FIG. 2 illustrates a conventional technique of driving the subpixels of the pixel groups in the color display of FIG. 1, utilizing bright state signals and dark state signals.

As shown in FIG. 8, the subpixels represented by slanted lines are driven by dark state signals, and the subpixels driven by the dark state signals are distributed uniformly across the pixel groups to reduce the problem of uneven picture experienced by some conventional arrangements of pixels, as shown in FIG. 2, and at the same time, improve color distortion and viewing angle by driving via both bright state signal and dark state signal.

Figure 19:
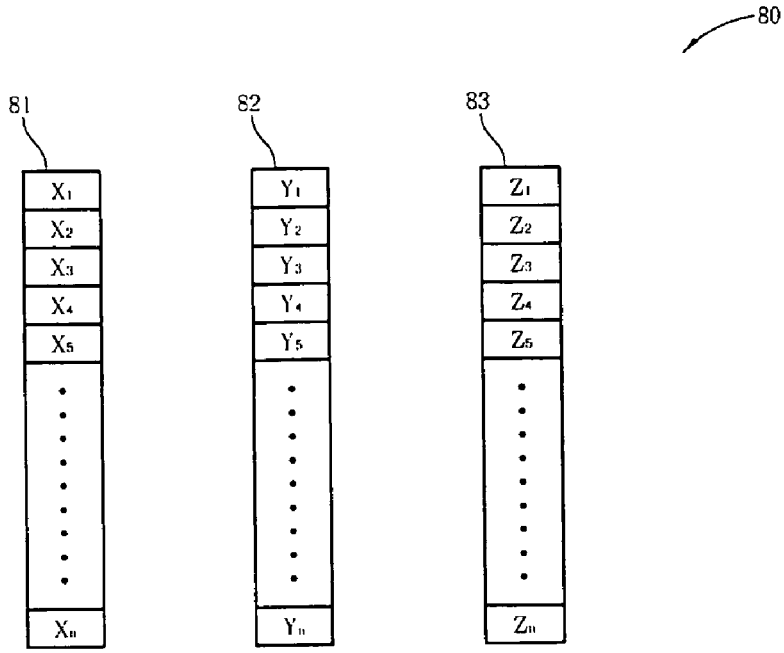
FIG. 19 illustrates a lookup table of the color display according to some embodiments of the present invention.

As shown in FIG. 19, the bright state signals and the dark state signals are obtained by a lookup table (or multiple lookup tables) 80, in which the lookup table 80 includes an original gray scale signal group 81, a bright state signal group 82, and a dark state signal group 83. In one embodiment, the lookup table 80 contains signal groups for the blue and green colors. Alternatively, two lookup tables 80 can be used for the blue and green colors. Note that dark and bright state signals are not used for the red color, according to one embodiment. However, in other embodiments, dark and bright state signals can be used for the red color, in which case the lookup table(s) 80 can contain information also for the red color. For instance, the X1 value of the original gray scale signal group 81 maps into the bright state signal group 82 to obtain the corresponding Y1 value of the first bright state signal, and maps into the dark state signal group 83 to obtain the corresponding Z1 value of the first dark state signal. Consequently, the bright state signal obtained from the bright state signal group 82 is referred to as a lookup table bright state signal and the dark state signal obtained from the dark state signal group 83 is referred to as a lookup table dark state signal. The Xi, i=1, . . . , n, values represent original gray scale values, Yi values represent bright state gray scale values, and Zi values represent dark state gray scale values. For example, the Xi gray scale values can range from 0 to 255. A given original gray scale value Xi is thus mapped by the lookup table to a corresponding bright state gray scale value Yi and dark state gray scale value Zi. Although FIG. 19 shows one lookup table 80 that contains both dark state and bright state signal groups, it is noted that multiple lookup tables can be used, one table to map original gray scale values to bright state gray scale values, and the other table to map original gray scale values to dark state gray scale values.

In one embodiment, the bright state signal and the dark state signal output to the subpixels are referred to as a bright state output signal and a dark state output signal. According to a first driving mode of the color display 30 of the first embodiment, the actual bright state output signal output to the subpixels is equivalent to the lookup table bright state signal obtained from the bright state signal group 82, and the actual dark state output signal output to the subpixels is equivalent to the lookup table dark state signal obtained from the dark state signal group 83 (as depicted in FIG. 8). As stated previously, the green bright state signal group and the dark state signal group corresponding to the original green signal of the first pixel group 31 are further utilized to generate the first green bright state signal and the first green dark state signal for driving the pixel groups, and the green first subpixel 311 and the green second subpixel 312 are combined to form the green color (G1) of the first pixel group 31.

The terms used in the present discussion are explained below.

Original gray scale signal: the original gray scale signal of each unadjusted color pixel transferred from the signal end to the pixel groups of the display, in which the signals are shown without H or L in the figures. For instance, as shown in FIG. 8, the red third subpixel 313 and the red fourth subpixel 314 of the first pixel group 31 are both driven by a first red original gray scale signal, hence both are represented by R1.

Adjusted original gray scale signal: obtained by adjusting the original gray scale signal via a specific calculation (e.g., interpolation).

Dark state signal: the dark state signal corresponding to the original gray scale signal or the adjusted original gray scale signal, in which the signals are shown with L in the figures. For instance, as shown in FIG. 8, the green first subpixel 311 of the first pixel group 31 is driven by a first green dark state signal, as represented by L (GI).

Bright state signal: the bright state signal corresponding to the original gray scale signal or the adjusted original gray scale signal, in which the signals are shown with H in the figures. For instance, as shown in FIG. 8, the green second subpixel 312 of the first pixel group 31 is driven by a first green bright state signal, as represented by H (G1).

Lookup table dark state signal: the dark state signal obtained from the corresponding dark state signal group of the original gray scale signal or the adjusted gray scale signal.

Lookup table bright state signal: the bright state signal obtained from the corresponding bright state signal group of the original gray scale signal or the adjusted gray scale signal.

Dark state output signal: the actual dark state signal output to the subpixels, in which the dark state output signal is equal to the lookup table dark state signal directly or calculated by the lookup table dark state signal.

Bright state output signal: the actual bright state signal output to the subpixels, in which the bright state output signal is equal to the lookup table bright state signal directly or calculated by the lookup table bright state signal.

Figure 20:
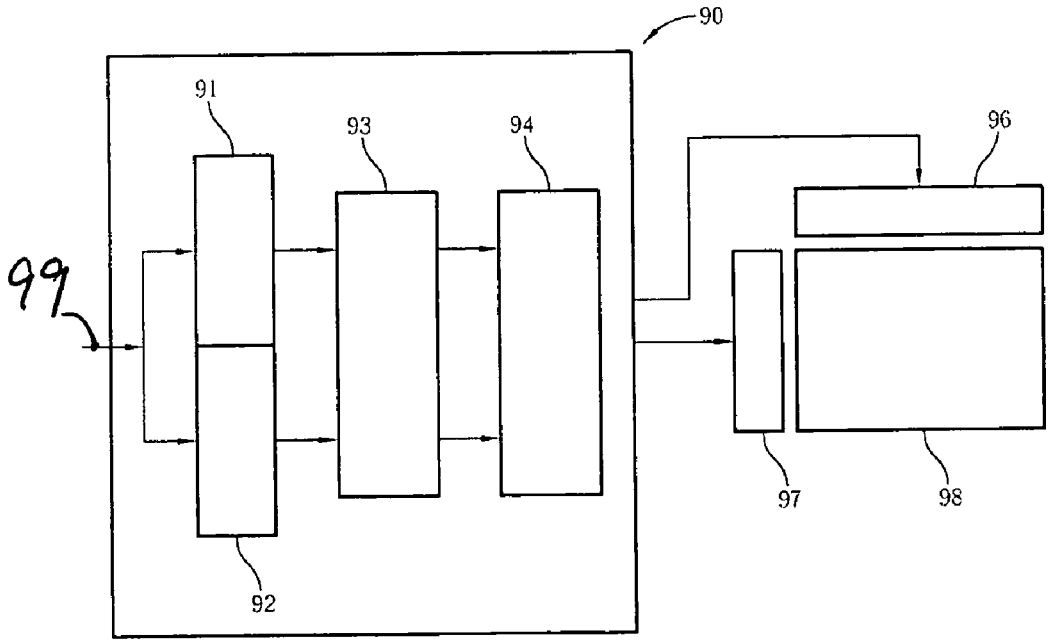
FIG. 20 is a block diagram of a signal processing system according to an embodiment.

FIG. 20 is a block diagram of a signal processing system 90 according to some embodiments. The signal processing system 90 includes a first lookup table 91, a second lookup table 92, a data selector 93, and a timing controller 94. The lookup table 91 can include the original gray scale signal group 81 and bright state signal group 82 of FIG. 19; and the lookup table 92 can include the original gray scale signal group 81 and dark state signal group 83 of FIG. 19. After raw data (corresponding to the original gray scale signal) is input into the first lookup table 91 and the second lookup table 92 from the signal end 99. The raw data is converted to a bright state signal by the lookup table 91, and is converted to a dark state signal by the lookup table. The bright state signal or dark state signal is selected by the data selector 93 as a data signal. The data signal is then transmitted from a timing controller 94 to a data driver 96 to operate a scanning driver 97 and enable a display 98 to show images. The data driver 96 drives the dark state signal or bright state signal to a respective subpixel. The scanning driver 97 activates a scan line (or row) of pixels in the display 98 to select the row of pixels.

A second driving mode according to the first embodiment is described as follows. A group of output signals (hence a bright state output signal and a dark state output signal) is used to generate an original gray scale signal. However, as the human eye tends to take the bright state output signal as the center of attraction when viewing objects in a display, the strength of the input dark state signal under the resolution of original signal will alter under different images and cause the weight of the light intensity to change accordingly. By taking the average of adjacent dark state signals in two or more pixels, this embodiment is able to more uniformly balance the weight of the dark state signal of different colors within each pixel, such that the averaged dark state signals are still able to complete the effect of the displayed object and reduce the phase shift of the each color signal and the flickering phenomenon of the images.

Figure 9:
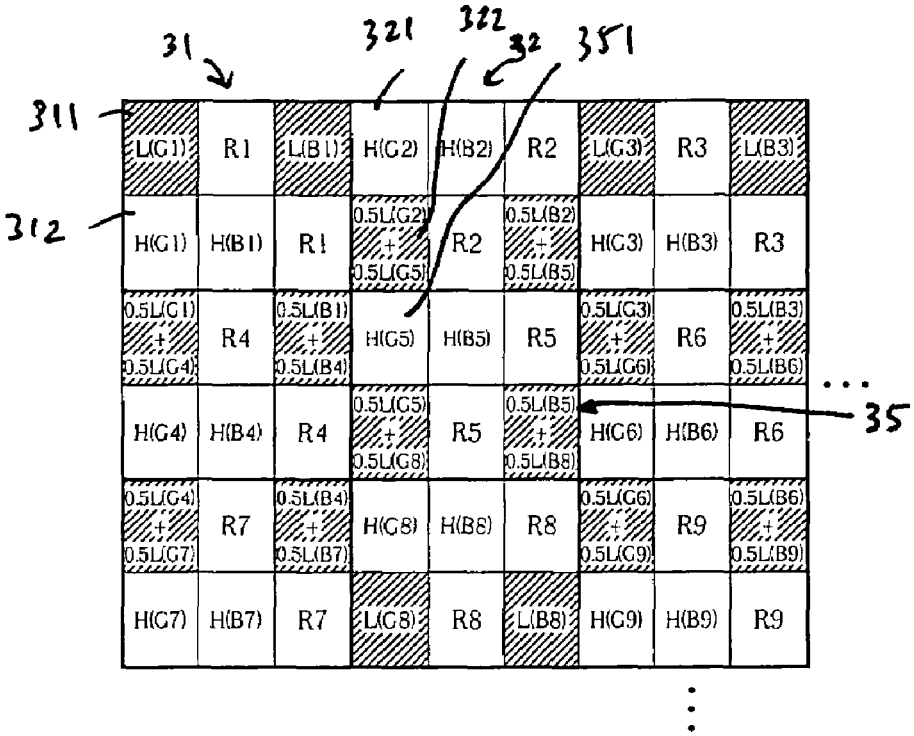
FIG. 9 illustrates a second driving mode to drive subpixel signals to the color display according to the first embodiment.

According to the second driving mode, the actual bright state output signal output to the subpixels is equivalent to the lookup table bright state signal obtained from the bright state signal group 82, and the actual dark state output signal output to a given subpixel of a particular color is the average of the lookup table dark state signals corresponding to two subpixels of identical color that are adjacent the given subpixel. For instance, the second green dark state signal of the green second subpixel 322 of the second pixel group 32 is the average of the corresponding lookup table dark state signal of the two green subpixels 321 and 351 that are adjacent the subpixel 322. In the example of FIG. 9, the dark state signal for subpixel 322 is 0.5 L(G2)+0.5 L(G5), which is the sum of half the lookup table dark state signal for the original gray scale signal for green pixel G2, and half the lookup table dark state signal for the original gray scale signal for green pixel G5. Thus, for example, the dark state signal for subpixel 322 is the average of the second lookup table green dark state signal (take Z2 for example) and the fifth lookup table green dark state signal (take Z5 for example). Hence, the second green dark state output signal equals ½ (the second lookup table green dark state signal+fifth lookup table green dark state signal)=½ (Z2+Z5), in which the fifth lookup table green dark state signal is the corresponding fifth lookup table green dark state signal (Z5) obtained by the original green gray scale signal of fifth pixel group (such as value X5), which is displayed by the fifth pixel group adjacent to the second pixel group 32.

As shown in FIG. 9, the original green signal (hence the second original green signal) of the second pixel group 32 corresponds to the bright state signal group to generate the corresponding green bright state output signal (hence the second lookup table green bright state signal) and drive the first green subpixel 321. Also, the original signal (the original green signal of the second pixel group 32) of the adjacent green subpixel 321 is utilized by the green dark state output signal, which is utilized to drive the second green subpixel 322, to correspond dark state signal group for generating the green dark state signal (the second lookup table green dark state signal, which is represented by L(G2) in the FIG. 9 with the value Z2). Next, the original signal (the original green signal of the fifth pixel group 35) of the green first subpixel 351 of the fifth pixel group 35, which is adjacent to the green second subpixel 322 of the second pixel group 32, is obtained to correspond to the dark state signal group for generating the corresponding green dark state signal (the fifth lookup table green dark state signal, which is represented by L(G5) in the FIG. 9 with the value Z5). The green dark state output signal utilized to drive the green second subpixel 322 is the average of the second lookup table green dark state signal and the fifth lookup table green dark state signal discussed previously, hence 0.5(Z2)+0.5(Z5), in which the average is represented by 0.5 L(G2)+0.5 L(G5) in FIG. 9.

Similarly, the blue dark state output signal of the blue sixth subpixel 326 of the second pixel group 32 is the average of the corresponding lookup table dark state signals of the two blue subpixels 325 and 355 adjacent to subpixel 326. The original signal (such as the original blue signal with value X30 of the second pixel group 32) of the adjacent blue fifth subpixel 325 is utilized to correspond to the dark state signal group to generate the corresponding blue dark state signal (the second lookup table blue dark state signal with value Z30, which is represented by L(B2) in FIG. 9), and the original blue signal (with value X60 for instance) of the fifth pixel group 35 adjacent to the blue sixth subpixel 326 of the second pixel group 32 is also utilized to correspond to the dark state signal group to generate the corresponding blue dark state signal (the fifth lookup table blue dark state signal with value Z60, which is represented by L(B5) in FIG. 9. Hence, the blue dark state output signal utilized to drive the blue second subpixel 326 is essentially the average of the second lookup table blue dark state signal and the fifth lookup table blue dark state signal, which is calculated by 0.5(Z30)+0.5(Z60) or represented as 0.5 L(B2)+0.5 L(B5) in FIG. 9.

As discussed previously, the first lookup table green bright state signal generated by corresponding the original green signal (such as the first original green signal) of the first pixel group 31 with bright state signal group is essentially the green bright state output signal, which is utilized to drive the second green subpixel 312. When the green first subpixel 311 is disposed on the edge of the frame, the green dark state output signal of the green first subpixel 311 can be processed according to the following two methods: (1) a first method that maps the original green signal of the first pixel group 31 (the original signal of the green subpixel 311) to the dark state signal group to generate the corresponding green dark state signal (the first lookup table green dark state signal); and (2) a second method that maps the original green signal of the fourth pixel group 34 (the original signal of the green subpixel 341) adjacent to the first pixel group 31 to the dark state signal group to generate the corresponding green dark state signal (the fourth lookup table green dark state signal). Similarly, the dark state output signals of other subpixels can also be calculated according to the methods described above.

In contrast to the first driving mode, the second driving mode calculates and adjusts the average value of the lookup table dark state signal of two adjacent pixels to obtain the dark state output signal. Hence, the actual dark state output signal output to the subpixels is derived from (but not the same as) the corresponding lookup table dark state signal obtained from the lookup table.

A third driving mode according to the first embodiment is discussed below. A group of output signals (such as a bright state output signal and a dark state output signal) may be required to form an accurate signal. However, under the resolution of the original signal, the number of required pixels of a display will increase as the signal input into the display increases. According to the third driving mode, an interpolation technique can be utilized to increase the resolution of the image and compensate for the excessive requirement of number of pixels. By utilizing the interpolation technique of the third driving mode and according to the average of the original display signal of the adjacent pixel group, the bright state output signal or the dark state output signal of the subpixels of the second row of a pixel group are adjusted as follows: the first row original gray scale signals (for a given color) of adjacent pixel groups are utilized to calculate the adjusted original gray scale signal of the second row of each pixel group (for the given color). Hence, the average of the original gray scale signal (for a given color) of the subpixel of a given pixel group and the original gray scale signal (for the given color) of the subpixel of the adjacent pixel group is first obtained and utilized as an adjusted original gray scale signal (for the given color) of the subpixel. Next, the adjusted original gray scale signal is utilized to obtain the corresponding lookup table bright state signal or the lookup table dark state signal.

The interpolation technique according to the third driving mode is applied to each second row subpixel in the pixel groups. Thus, the second row subpixels are considered to be part of the "interpolation region" where the interpolation technique according to the third driving mode is applied.

Figure 10:
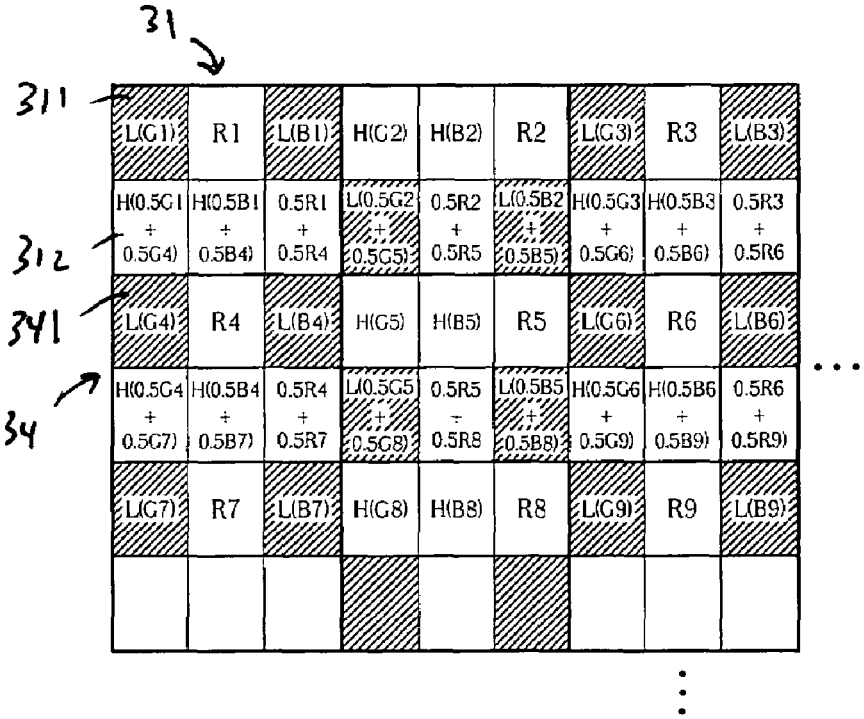
FIG. 10 illustrates a third driving mode to drive subpixel signals to the color display according to the first embodiment.

As shown in FIG. 19 and FIG. 10, the green second subpixel 312 of the first pixel group 31 is disposed in the second row of the first pixel group 31 and the original gray scale signal (assumed to be X1) of the green second subpixel 312 is the original green gray scale signal of the first pixel group 31. The green first subpixel 341 of the fourth pixel group 34 is adjacent the green second subpixel 312, and the original gray scale signal (assumed to be X4) of the green second subpixel 312 is the original gray scale signal of the fourth pixel group 34. By utilizing the interpolation technique, the adjusted original gray scale signal of the green second subpixel 312 is first obtained by taking the average (assuming the value to be X2) of the value X1 and X4, hence ½(X1+X4). The adjusted original gray scale signal (X2) is utilized to map to the bright state signal group 32 to obtain a corresponding lookup table bright state signal (such as a value Y2, which is represented by H(0.5G1+0.5G4) in the FIG. 10), in which the lookup table bright state signal (Y2) is utilized to output to the green second subpixel 312 as the bright state output signal. Similarly, the bright state output signal of each of the other second row subpixels of respective pixel groups can also be obtained by mapping each respective adjusted gray scale signal calculated using the interpolation technique with the corresponding bright state or dark state signals.

A fourth driving mode according to the first embodiment is described as follows. The fourth driving mode essentially combines the second driving mode and the third driving mode described above, in which the second driving mode processes the dark state output signals and the third driving mode processes the interpolation region (second row subpixels of each pixel group). The interpolation technique of the third driving mode is first utilized to obtain the bright or dark state signals based on mapping (with the lookup table) the adjusted gray scale signal to the corresponding bright or dark state signal. The second driving mode is utilized to adjust the dark state output signal output to the subpixels of a particular color to an average value. The average value is the average of the corresponding lookup table dark state signals of the two identical color subpixels of subpixels adjacent a given subpixel.

Figure 11:
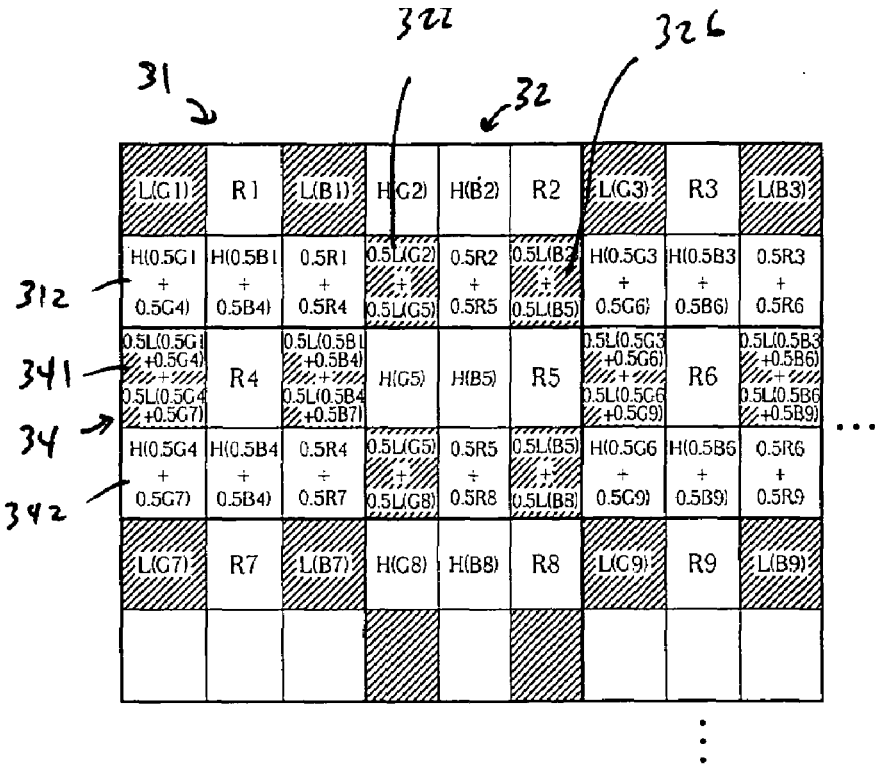
FIG. 11 illustrates a fourth driving mode to drive subpixel signals to the color display according to the first embodiment.

As shown in FIG. 11, the green dark state output signal utilized for driving the green second subpixel 322 and the blue dark state output signal utilized for driving the blue second subpixel 326 within the second pixel group 32 are generated based on the second driving mode.

In the first pixel group 31, the green bright state output signal of the second green subpixel 312 is the first adjusted green gray scale signal (e.g., X45), in which the first adjusted green gray scale signal is obtained by calculating the average between the original green gray scale signal (e.g., X30) of the first pixel group 31 and the original green gray scale signal (e.g., X60) of the fourth pixel group 34. Next, the first adjusted green gray scale signal is utilized to obtain the lookup table green bright state signal (such as Y45, which is represented by H(0.5G1+0.5G4)) in FIG. 11.

In the fourth pixel group 34, the green bright state output signal of the second green subpixel 342 is the fourth adjusted green gray scale signal (e.g., X75), in which the fourth adjusted green gray scale signal is obtained by calculating the average between the original green signal (e.g., X60) of the fourth pixel group 31 and the original green signal (e.g., X90) of the seventh pixel group 37 via the interpolation method. Next, the fourth adjusted green gray scale signal is utilized to obtain the lookup table green bright state signal (such as Y75, which is represented by H(0.5G4+0.5G7)) in FIG. 11.

In the fourth pixel group 34, the green dark state output signal of the first green subpixel 341 is the average of the corresponding lookup table dark state signals of the two green subpixels 312 and 342 adjacent the subpixel 341. Since the first adjusted green gray scale signal (e.g., X45) of the second green subpixel 312 of the adjacent pixel group 31 can be utilized to obtain the corresponding first lookup table green dark state signal (e.g., Z45), the fourth adjusted green gray scale signal (e.g., X75) of the adjacent green second subpixel 342 can also be utilized to obtain the corresponding fourth lookup table green dark state signal (e.g., Z75). Hence, the green dark state output signal of the green first subpixel 341 is essentially the average of the first lookup table green dark state signal (e.g., Z45) and the fourth lookup table dark state signal (e.g., Z75), which is shown as (0.5(Z45+Z75)) or represented by 0.5 L(0.5 G+0.5G4)+0.5L(0.5 G4+0.5G7) in FIG. 11.

A fifth driving mode according to the first embodiment is described as follows. The fifth driving mode is essentially an extension of the third driving mode. In addition to utilizing the interpolation technique to obtain the average of the second row subpixels of the pixel groups, the interpolation technique of the third driving mode can additionally be utilized to obtain, within a pixel group, the average of the original signal (for a given color) of the subpixel in the first row, third column and the original signal (for the given color) of the pixel group adjacent to the third column. The average is utilized as an adjusted gray scale signal that is used to drive a subpixel for which bright or dark state signaling is not used. Also, the adjusted gray scale signal is used to map, using the lookup table, to either the corresponding bright state or dark state signal group for obtaining corresponding bright state output signal or dark state output signal of each subpixel.

Figure 12:
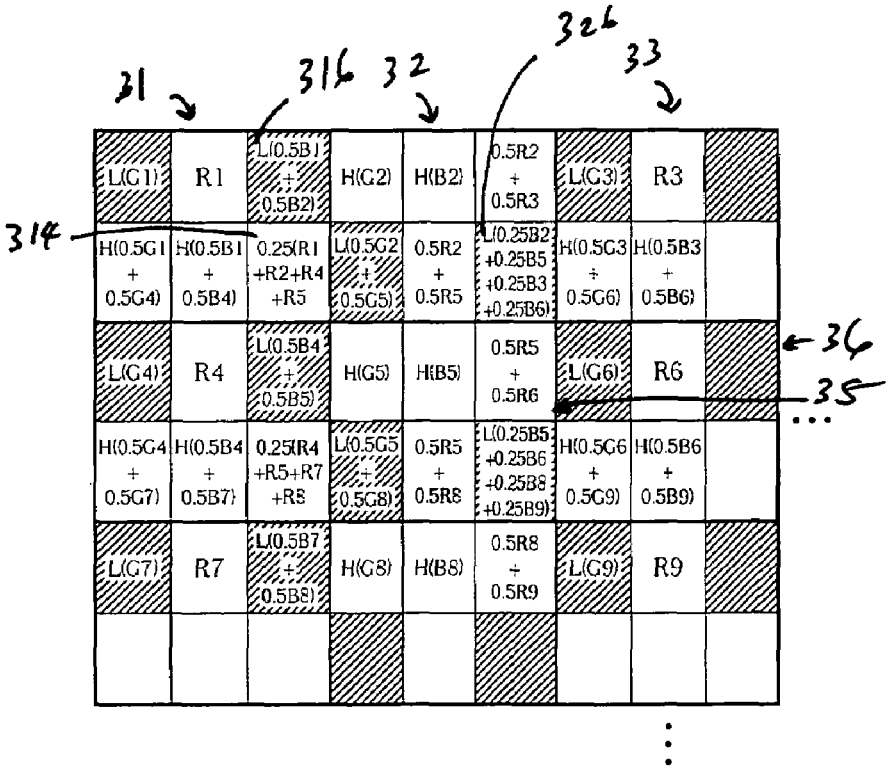
FIG. 12 illustrates a fifth driving mode to drive subpixel signals to the color display according to the first embodiment.

As shown in FIG. 12, the blue sixth subpixel 316 is disposed in the first row and third column of the first pixel group 31, such that the interpolation technique described above is utilized to obtain an average value for subpixel 316. The blue dark state output signal of the blue sixth subpixel 316 is derived by first obtaining the average of the original blue signal (e.g., X30) of the first pixel group 31 and the original blue signal (e.g., X60) of the second pixel group 32. Subsequently, the calculated first adjusted blue gray scale signal (the average derived above, for example, X45) is utilized to map to a first lookup table blue dark state signal (e.g., Z45), which is the output signal of the blue sixth subpixel 316, and represented by L(0.5B1+0.5B2) in FIG. 12.

In the first pixel group 31, the red fourth subpixel 314 is disposed in the second row and third column of the first pixel group 31 in proximity to the second pixel group 32, the fourth pixel group 34, and the fifth pixel group 35. The red output signal of the fourth red subpixel 314 is a first adjusted red gray scale signal, which is obtained by calculating the average of the original red signal (e.g., X30) of the first pixel group 31, the original red signal (e.g., X60) of the second pixel group 32, the original red signal (e.g., X70) of the fourth pixel group 34, and the original red signal (e.g., X80) of the fifth pixel group 35, such as 0.25(X30+X60+X70+X80)=X60 or represented by 0.25(R1+R2+R4+R5) in the FIG. 12.

Similarly, the blue sixth subpixel 326 is disposed in the second row and third column of the second pixel group 32 in proximity to the third pixel group 33, the fifth pixel group 35, and the sixth pixel group 36. The blue output signal of the blue sixth subpixel 326 is derived by first obtaining the second adjusted blue gray scale signal, which is obtained by calculating the average of the original blue signal (e.g., X30) of the second pixel group 32, the original blue signal (take X60 as example) of the third pixel group 33, the original blue signal (e.g., X70) of the fifth pixel group 35, and the original blue signal (e.g., X80) of the sixth pixel group 36, such as 0.25 (X30+X60+X70+X80)=X60. Then, the result of the second adjusted blue gray scale signal is utilized to obtain the corresponding lookup table blue dark state signal, such as Z60, which is the blue output signal of the blue sixth subpixel 326, and represented by L(0.25(B2+B3+B5+B6)) in FIG. 12. In other words, the fifth driving mode utilizes the interpolation technique for calculating driving signals for subpixels of the second row of each pixel group, and for subpixels of first row, third column of each pixel group. However, note that the interpolation performed on the subpixels in the second row, third column of respective pixel groups for the fifth driving mode is different from the third driving mode. For these subpixels, the interpolation produces an average of signals in four adjacent pixel groups (instead of just two).

A sixth driving mode according to the first embodiment is described as follows. The sixth driving mode combines the second driving mode and the fifth driving mode described above. Taking the second pixel group as an example, since the green subpixels 321 and 351 that are adjacent the green second subpixel 322 (that is driven by utilizing the green dark state output signal), and the blue subpixels of 325 and 355 that are adjacent the blue second subpixel 326 (that is driven by utilizing the blue dark state output signal) are not within the interpolation region, the dark state output signals for subpixels 322 and 326 are derived essentially according to the second and fourth driving modes.

Figure 13:
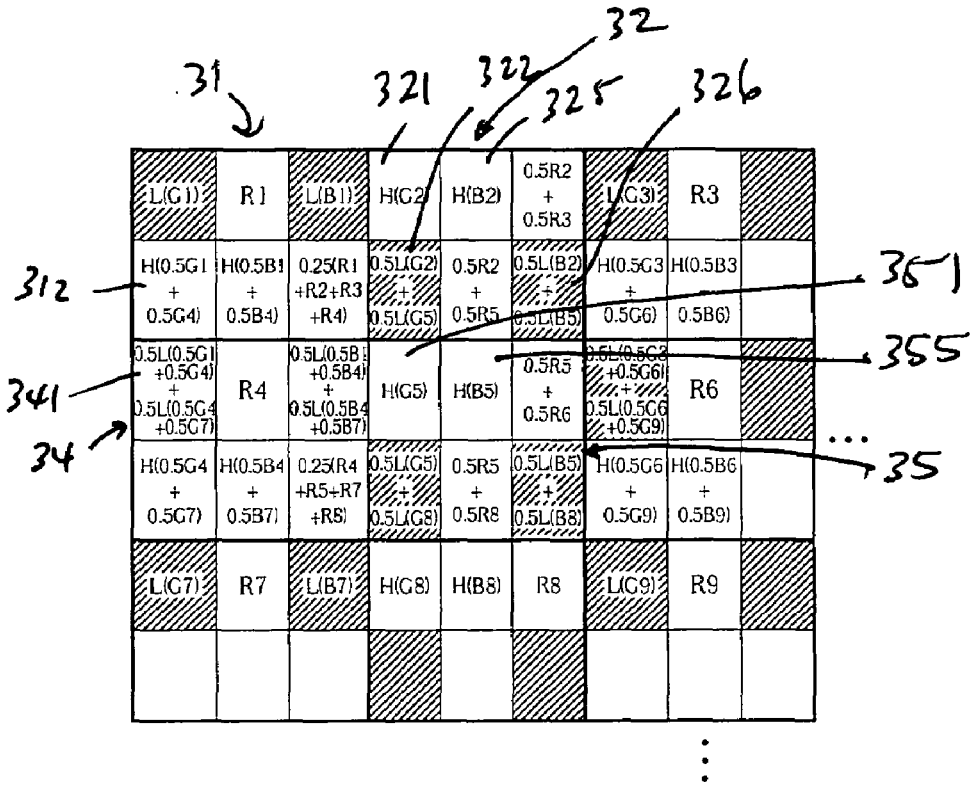
FIG. 13 illustrates a sixth driving mode to drive subpixel signals to the color display according to the first embodiment.

As shown in FIG. 13, the calculation method of the green dark state output signal of the green fourth subpixel 341 in the fourth pixel group 34 is identical to the fourth driving mode, which is the average of the lookup table green dark state signal of the corresponding first adjusted green gray scale signal (e.g., X45) and the fourth adjusted green gray scale signal (e.g., X75), such as 0.5(Z45+Z75), or represented by 0.5 L(0.5G1+0.5G4)+0.5 L(0.5G4+0.5G7) in FIG. 13. In the first pixel group 31, the green bright state signal of the green second subpixel 312 also utilizes the fourth driving mode. In other words, the interpolation of the fifth driving mode is utilized to manipulate the adjusted gray scale signal of the second row subpixels and first row, third column subpixels of the pixel groups to obtain an average value, and second driving mode is utilized to manipulate the dark state output signals to obtain another average value for some other subpixels.

A seventh driving mode according to the first embodiment is described as follows. The seventh driving mode is an extension of the fifth driving mode described above, in which the seventh driving mode extends the interpolation region of the fifth driving mode, to include the second row; first row, third column; and first row, second column subpixels of each pixel group. Additionally, different weight factors are utilized according to the distance between each subpixel and non-interpolated subpixel (original spot) of the pixel group to calculate the interpolated value of each subpixel and to adjust gray scale signals.

For instance, due to the proximity of the first row, first column non-interpolated pixel in each pixel group to the first row, second column subpixel of the same pixel group, the weight factor of the original gray signal of the subpixel in the first row, first column is 0.75. Additionally, the weight factor of the original gray scale signal of the subpixel in the first row, first column of each pixel groups in the adjacent column is 0.25. The weight factors described above are utilized to obtain adjusted gray scale signals.

Figure 14:
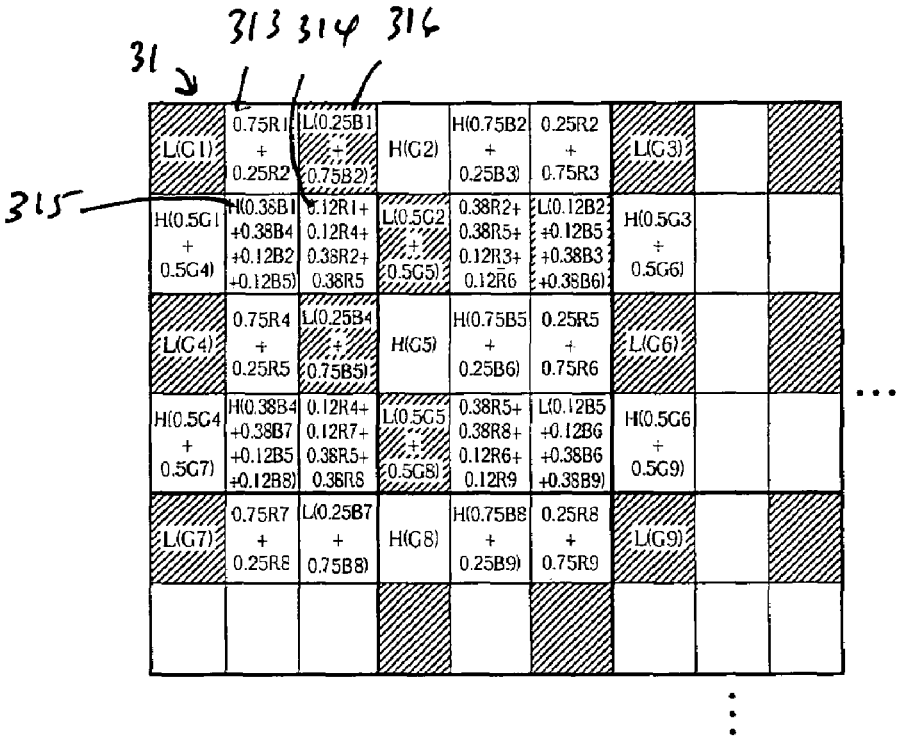
FIG. 14 illustrates a seventh driving mode to drive subpixel signals to the color display according to the first embodiment.

As shown in FIG. 14, the red output signal of the red third subpixel 313 in the first row, second column of the first pixel group 31 is a first adjusted red gray scale signal, which is obtained by calculating the sum of 0.75 (weight factor) times the original red signal (e.g., X30) of the first pixel group 31, and 0.25 (weight factor) times the original red signal of the adjacent second pixel group 32 (e.g., X60), which is shown as 0.75X30+0.25X60=X37.5 or 0.75R1+0.25R2 in FIG. 14.

Since the subpixel in the first row, third column of each pixel group is disposed adjacent to the un-interpolated subpixel in the first row, first column of the adjacent pixel group along a row, the weight factor of the original gray scale signal of the adjacent pixel group is 0.75, and the weight factor of the original gray scale signal of the pixel group is 0.25. The weight factors are then utilized to calculate the adjusted gray scale signal of the subpixel in the first row and third column.

For instance, the blue dark state output signal of the blue sixth subpixel 316 in the first row, third column of the first pixel group 31 is a first adjusted blue gray scale signal, which is obtained by calculating the sum of 0.25 times the original blue signal (e.g., X30) of the first pixel group 31, and 0.75 times the original blue signal (e.g., X60) of the second pixel group 32, which is 0.25X30+0.75X60=X52.5. Then, the result is utilized to obtain the first lookup table blue dark state signal (e.g., Z52.5), which is the blue dark state output signal of the blue sixth subpixel 316, and shown as L(0.25B1+0.75B2) in FIG. 14.

Since the distance between the subpixel at the second row, first column of each pixel group to the non-interpolated subpixel at the first row, first column of the pixel group is equal to the distance between the subpixel at the second row, first column of the pixel group and the non-interpolated subpixel of the first row, first column of the adjacent (in the column direction) pixel group, the signal of the subpixel at the second row, first column is interpolated by using the 0.5 weight factor of the original gray scale signal of the first row, first column of the pixel group, and the 0.5 weight factor of the original gray scale signal of the first row, first column of adjacent pixel group in the column direction.

The weight factors for calculating the adjusted gray scale signal of the second row, second column of each given pixel group is as follows. A weight factor of 0.38 is applied to the original gray scale signals of the given pixel group and of an adjacent pixel group along the column direction (i.e., in the next pixel group row). Also, a weight factor of 0.12 is applied to the original gray scale signals of the pixel group that is adjacent in the row direction and another pixel group that is diagonally adjacent (in the next pixel group column and row).

For instance, the blue bright state output signal of the blue fifth subpixel 315 in the second row, second column of the first pixel group 31 is a first adjusted blue gray scale signal, which is obtained by calculating the sum of 0.38 times the original blue signal of the first pixel group (e.g., 0.38X30), 0.12 times the original blue signal of the second pixel group 32 (e.g., 0.12X60) (the adjacent pixel group in the next pixel group column), 0.38 times the original blue signal of the fourth pixel group 34 (e.g., 0.38X70), and 0.12 times the original blue signal of the fifth pixel group 35 (e.g., 0.12X80) (the diagonally adjacent pixel group in the next pixel group row and column). The first adjusted blue gray scale signal is represented as 0.38X30+0.12X60+0.38X70+0.12X80=X54.8, in one example. The result is utilized to obtain the corresponding first lookup table blue bright state signal (e.g., Z54.8), which is shown as H(0.38B1+0.38B4+0.12B2+0.12B5) in FIG. 14.

The weight factors for calculating the adjusted gray scale signal of the second row, third column of each given pixel group is as follows: a weight factor of 0.12 is applied to the original gray scale signals of the given pixel group and of the adjacent pixel group in the next pixel group row. A weight factor of 0.38 is applied to the original gray scale signals of the adjacent pixel group in the next pixel group column, and of the diagonally adjacent in the next pixel group column and row. By utilizing the weight factors listed above, the signal of the subpixel in the second row, third column of each pixel group can be calculated.

For instance, the red output signal of the red fourth subpixel 314 in the second row, third column of the first pixel group 31 is a first adjusted red gray scale signal, which is obtained by calculating the sum of 0.12 times the original red signal of the first pixel group (e.g., 0.12X30), 0.38 times the original red signal of the adjacent second pixel group 32 in the next pixel group column (e.g., 0.38X60), 0.12 times the original red scale of the adjacent fourth pixel group 34 (0.12X70) in the next pixel group row, and 0.38 times the original red signal of the diagonally adjacent fifth pixel group 35 (e.g., 0.38X80), which is 0.12X30+0.38X60+0.12X70+0.38X80=X65.2 or shown as 0.12R1+0.12R4+0.38R2+0.38R5 in FIG. 14.

An eighth driving mode according to the first embodiment is described as follows. The eighth driving mode essentially combines the second driving mode and the seventh driving mode described previously. Hence, in addition to the seventh driving mode of utilizing interpolation to manipulate the adjusted gray scale signal of the subpixels of the second row; the first row, and third column; and the first row, second column of each pixel group to an average value, the second driving mode is utilized to correct the dark state output signals such that the actual dark state output signal of the subpixels output to a particular color is calculated to be an average value, in which the average value is the average of the corresponding lookup table dark state signals of the subpixels of two identical color of adjacent subpixels. For instance, as depicted in FIG. 15, the green dark state signal utilized for driving the green subpixel 322 in the second pixel group 32 is not within the interpolation region, hence the dark state output signal will be equivalent as the second driving mode.

Figure 15:
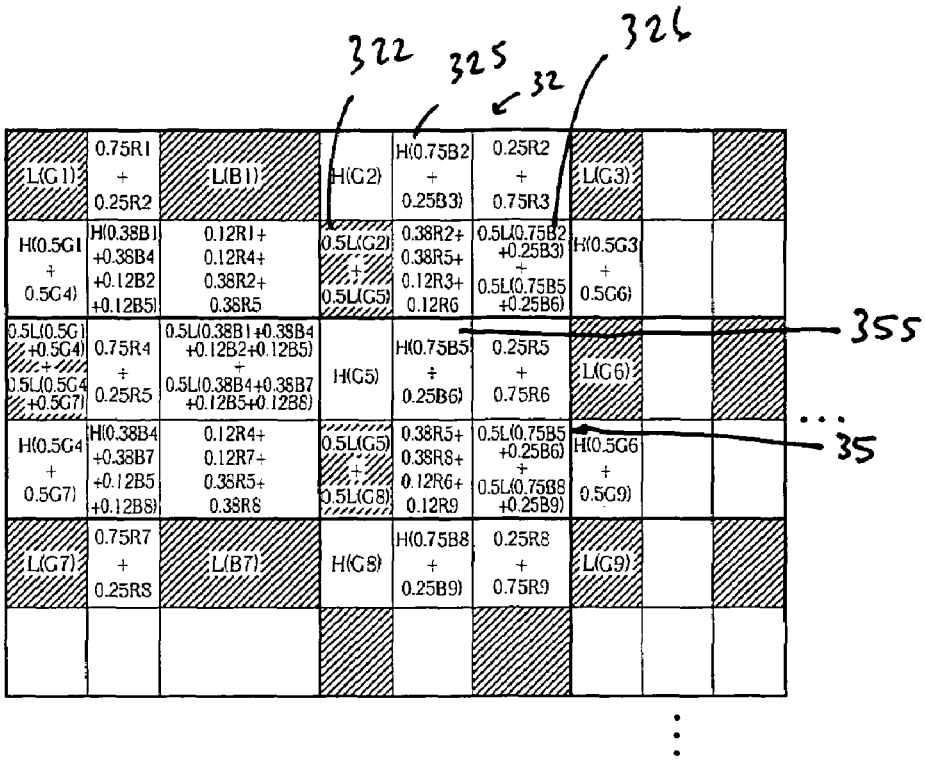
FIG. 15 illustrates a eighth driving mode to drive subpixel signals to the color display according to the first embodiment.

As shown in FIG. 15, the blue bright state output signal of the blue fifth subpixel 325 in the second pixel group 32 is a second adjusted blue gray scale signal, which is obtained by calculating the sum of 0.75 times the original blue signal (e.g., X30) of the second pixel group 32 and 0.25 times the original blue signal (e.g., X60) of the third pixel group 33, which is shown as 0.75X30+0.25X60=X37.5. The result if utilized to obtain the corresponding second lookup table blue bright state signal (e.g., Y37.5), which is shown as H(0.75B2+0.25B3) in FIG. 15.

In the fifth pixel group 35, the blue bright state output signal of the blue fifth subpixel 355 is a fifth adjusted blue gray scale signal, which is obtained by calculating the sum of 0.75 times the original blue signal (e.g., X60) of the fifth pixel group 35 and 0.25 times the original blue signal (e.g., X90) of the sixth pixel group 36, which is shown as 0.75X60+0.25X90=X67.5. The result is utilized to obtain the corresponding lookup table blue bright state signal (e.g., Y67.5), which is shown as H(0.75B5+0.25B6) in FIG. 15.

The blue dark state output signal of the blue sixth subpixel 326 in the second pixel group 32 is the average of the corresponding lookup table dark state signals of the two blue subpixels 325 and 355 adjacent subpixel 326. First, the second adjusted blue gray scale signal (e.g., X37.5) is obtained and the corresponding second lookup table blue dark state signal (e.g., Z37.5) is obtained. Next, the fifth adjusted blue gray scale signal (e.g., X67.5) of the blue subpixel 355 of the fifth pixel group 35 is obtained and the corresponding fifth lookup table blue dark state signal (e.g., Z67.5) is obtained. Hence the blue dark state output signal of the blue sixth subpixel 326 is average of the second lookup table blue dark state signal (e.g., Z67.5) and the fifth lookup table blue dark state signal (e.g., Z67.5), which is shown as 0.5(Z37.5+Z67.5) or 0.5 L(0.75B2+0.25B3)+0.5 L(0.75B5+0.25B6) in FIG. 15.

Figure 16:
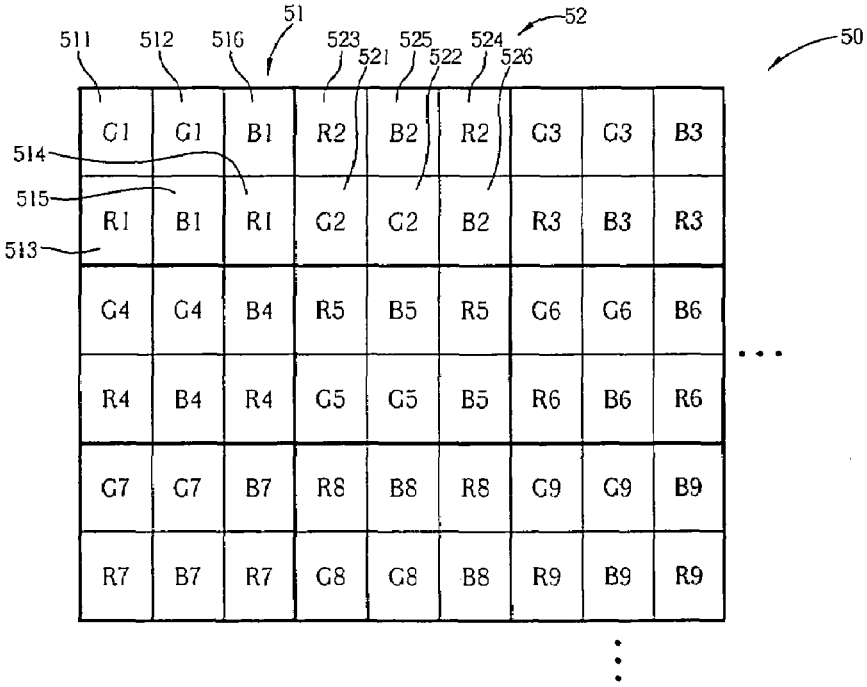
FIG. 16 illustrates a subpixel arrangement of the pixel groups of a color display according to a second embodiment.

FIG. 16 shows pixels of the color display 50 according to a second embodiment of the invention. As shown in FIG. 16, the color display 50 includes a plurality of pixel groups 51 and 52, in which each of the pixel groups 51 and 52 is arranged in a matrix. Each pixel group includes a first color pixel, a second color pixel, and a third color pixel. Taking the first pixel group 51 as an example, the first color pixel is a green pixel, the second color pixel is a red pixel, and the third color pixel is a blue pixel. The green pixel includes a first green subpixel 511 and a second green subpixel 512, the red pixel includes a third red subpixel 513 and a fourth red subpixel 514, and the blue pixel includes a fifth blue subpixel 515 and a sixth blue subpixel 516.

The first green subpixel 511 and the third red subpixel 513 are disposed adjacent to each other and in the first column of the first pixel group 51. The second green subpixel 512 and the fifth blue subpixel 515 are disposed adjacent to each other and in the second column of the first pixel group 51. The fourth red subpixel 514 and the sixth blue subpixel 516 are disposed adjacent to each other and in the third column of the first pixel group 51.

The subpixels of the first pixel group 51 and the second pixel group 52 are arranged in a matrix in two rows and three columns. Additionally, the subpixels of the first pixel group 51 and the second pixel group 52 are arranged according to the following rules: the first subpixel and the third subpixel are disposed in the first column, the second subpixel and the fifth subpixel are disposed in the second column, and the fourth subpixel and the sixth subpixel are disposed in the third column.

The arrangement (second arrangement) of the subpixels within the second pixel group 52 is different from the arrangement (first arrangement) of the subpixels within the first pixel group 51. The first green subpixel 51 of the first pixel group 51 is disposed in the first row and first column of the first pixel group 51, the third red subpixel 513 of the first pixel group 51 is disposed in the second row and first column of the first pixel group 51, the second green subpixel 512 of the first pixel group 51 is disposed in the first row and second column of the first pixel group 51, the fifth blue subpixel 515 of the first pixel group 51 is disposed in the second row and second column of the first pixel group 51, the sixth blue subpixel 516 of the first pixel group 51 is disposed in the first row and third column of the first pixel group 51 and the fourth red subpixel 514 of the first pixel group 51 is disposed in the second row and third column of the first pixel group 51.

The subpixels within the second pixel group 52 include the following arrangement. The first green subpixel 521 of the second pixel group 52 is disposed in the second row and first column of the second pixel group 52, the third red subpixel 523 of the second pixel group 52 is disposed in the first row and first column of the second pixel group 52, the second green subpixel 522 of the second pixel group 52 is disposed in the second row and second column of the second pixel group 52, the fifth blue subpixel 525 of the second pixel group 52 is disposed in the first row and second column of the second pixel group 52, the sixth blue subpixel 526 of the second pixel group 52 is disposed in the second row and third column of the second pixel group 52, and the fourth red subpixel 524 of the second pixel group 52 is disposed in the first row and third column of the second pixel group 52.

Hence, the subpixel arrangement of the first row and second row of the second pixel group 52 is totally opposite to the subpixel arrangement of the first row and second row of the first pixel group 52. In other words, the subpixel arrangement of the first row of the second pixel group 52 is the same as the subpixel arrangement of the second row of the first pixel group 51, and the subpixel arrangement of the second row of the second pixel group 52 is the same as the subpixel arrangement of the first row of the first pixel group 51.

The pixel groups having different arrangements are arranged in an alternating fashion, similar to the first embodiment depicted in FIG. 7.

Figure 17:
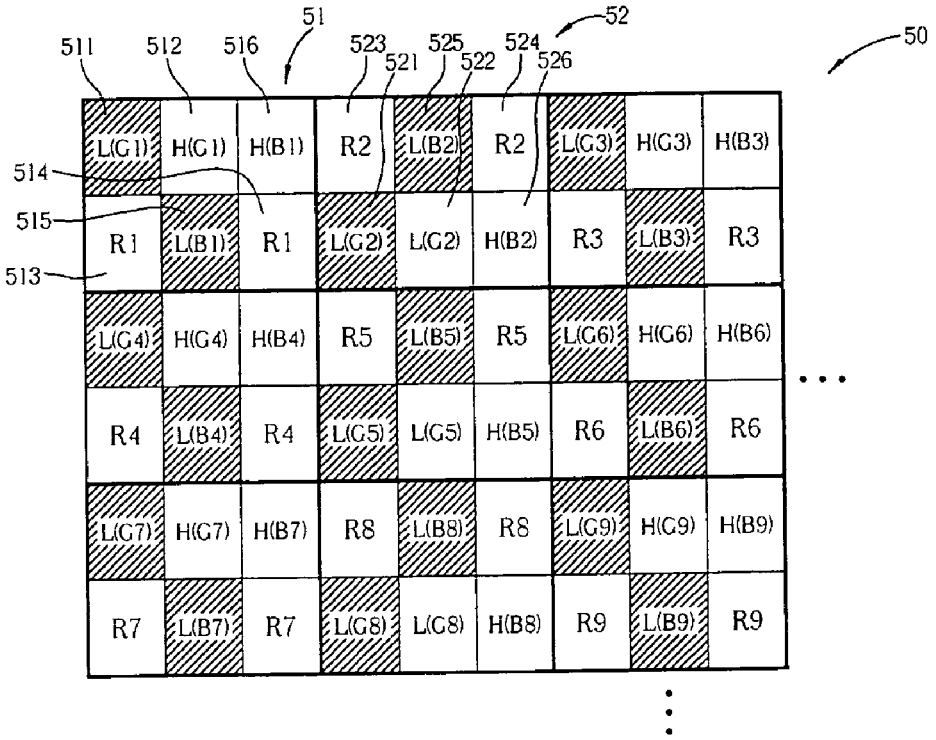
FIG. 17 illustrates a driving technique to drive subpixels of the pixel groups of the color display according to the second embodiment by utilizing bright state signals and dark state signals.

FIG. 17 shows a driving technique of the subpixels of each pixel group of the color display by utilizing bright state signal and dark state signal according to the second embodiment, in which the subpixels driven by dark state signals are represented by slanted lines. The green first subpixel 511 of the first pixel group 51 is driven by a first green dark state signal, the green second subpixel 512 of the first pixel group 51 is driven by a first green bright state signal, and the green first subpixel 511 and the green second subpixel 512 are combined to form the green color (G1) of the first pixel group 51. The red third subpixel 513 and the red fourth subpixel 514 of the first pixel group 51 are both driven by an original first red display signal and not driven by a red bright state signal or red dark state signal. The blue fifth subpixel 515 of the first pixel group 51 is driven by a first blue dark state signal, the blue sixth subpixel 516 is driven by a first blue bright state signal, and the blue fifth subpixel 515 and the blue sixth subpixel 516 are combined to form the blue color (B1) of the first pixel group 51.

The green first subpixel 521 of the second pixel group 52 is driven by a second green dark state signal, the green second subpixel 522 of the second pixel group is driven by a second green bright state signal, and the green first subpixel 521 and the green second subpixel 522 are combined to form the green color (G2) of the second pixel group 52. The red third subpixel 523 and the red fourth subpixel 524 of the second pixel group 52 are both driven by a second red display signal and not by a red bright state signal or red dark state signal. The blue fifth subpixel 525 of the second pixel group 52 is driven by a second blue dark state signal, the blue sixth subpixel 526 of the second pixel group 52 is driven by a second blue bright state signal, and the blue fifth subpixel 525 and the blue sixth subpixel 526 are combined to form the blue color (B2) of the second pixel group 52.

As shown in FIG. 17, the subpixels driven by the dark state signal are represented by slanted lines. Since the subpixels driven by the dark state signal are uniformly distributed within the pixel group, problems such as uneven brightness as shown in the FIG. 2 can be greatly reduced and the advantage of having much less color distortion and greater viewing angle by utilizing both bright state signal and dark state signal can also be maintained.

Figure 18:
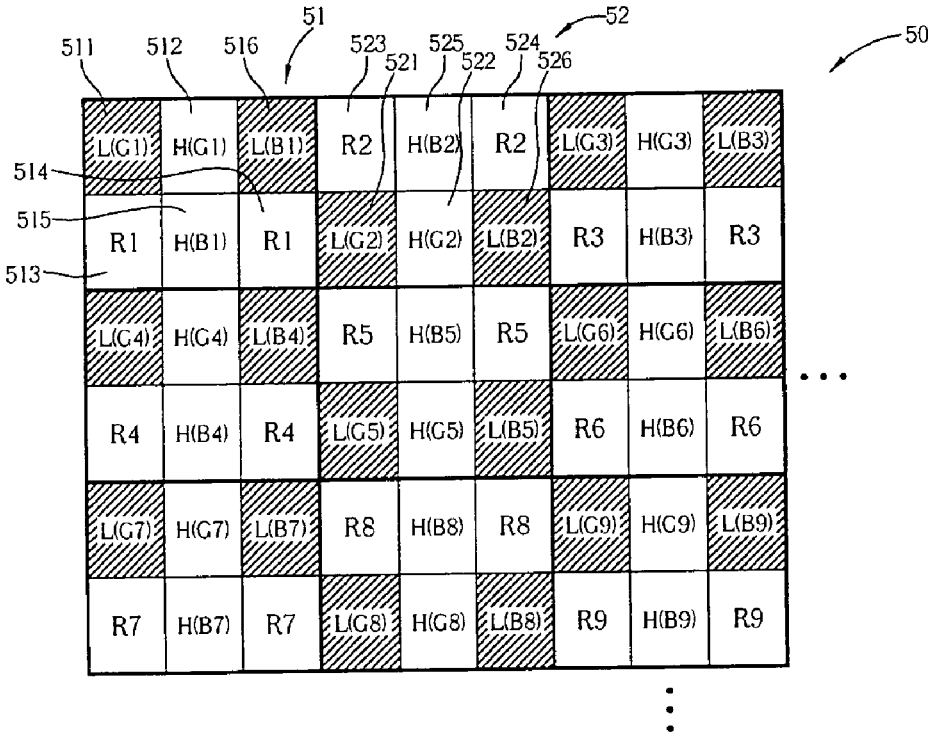
FIG. 18 illustrates another driving technique to drive subpixels of the pixel groups of the color display according to the second embodiment by utilizing bright state signals and dark state signals.

FIG. 18 shows another driving technique of the subpixel of the pixel group of the color display by utilizing bright state signal and dark state signal according to the second embodiment, in which the subpixels driven by dark state signals are represented by slanted lines. The green first subpixel 511 of the first pixel group 51 is driven by a first green dark state signal, the green second subpixel 512 of the first pixel group 51 is driven by a first green bright state signal, and the green first subpixel 511 and the green second subpixel 512 are combined to form the green color (G1) of the first pixel group 51. The red third subpixel 513 and the red fourth subpixel 514 of the first pixel group 51 are both driven by a first red display signal and not by a red bright state signal or red dark state signal. The blue fifth subpixel 515 of the first pixel group 51 is driven by a first blue bright state signal, the blue sixth subpixel 516 is driven by a first blue dark state signal, and the blue fifth subpixel 515 and the blue sixth subpixel 516 are combined to form the blue color (B1) of the first pixel group 51.

The green first subpixel 521 of the second pixel group 52 is driven by a second green dark state signal, the green second subpixel 522 of the second pixel group is driven by a second green bright state signal, and the green first subpixel 521 and the green second subpixel 522 are combined to form the green color (G2) of the second pixel group 52. The red third subpixel 523 and the red fourth subpixel 524 of the second pixel group 52 are both driven by a second red display signal and not by a red bright state signal or red dark state signal. The blue fifth subpixel 525 of the second pixel group 52 is driven by a second blue bright state signal, the blue sixth subpixel 526 of the second pixel group 52 is driven by a second blue dark state signal, and the blue fifth subpixel 525 and the blue sixth subpixel 526 are combined to form the blue color (B2) of the second pixel group 52.

As shown in FIG. 18, the subpixels driven by the dark state signal are represented by slanted lines. Since the subpixels driven by the dark state signal are uniformly distributed within the pixel group, problems such as uneven brightness as shown in the FIG. 2 can be greatly reduced and the advantage of having much less color distortion and greater viewing angle by utilizing both bright state signal and dark state signal can also be maintained.

The two bright state and dark state signal arrangements shown in FIG. 17 and FIG. 18 of the color display 50 of the second embodiment can also be processed according to the eight driving modes of the color display 30 of the first embodiment described above. By utilizing the first driving mode for the second embodiment, the actual bright state signal and dark state signal output to the subpixels are referred to as the bright state output signal and dark state output signal. The bright state output signal output to the subpixels is equal to the lookup table bright state signal obtained from the bright state signal group 82, and the dark state output signal output to the subpixels is equal to the lookup table dark state signal obtained from the dark state signal group 83.

By applying the second driving mode to the second embodiment, the actual bright state output signal output to the subpixels of a particular color is equal to the lookup table bright state signal obtained by the bright state signal group 82, and the actual dark state output signal output to the subpixels is the average of the corresponding lookup table dark state signals of two identical color subpixels of adjacent subpixels. However, since the green subpixel driven by the green dark state signal is not adjacent to the green subpixel of the adjacent pixel group, the second driving mode of processing the dark state output signal into an average value is only utilized in the blue subpixel driven by blue dark state signal, in which the output signals of other color subpixels are processed by the first driving mode.

Similar to the first embodiment, the application of the third driving mode to the second embodiment also involves the utilization of the interpolation technique, in which the bright state output signal or dark state signal of the second row subpixels of each pixel group is calculated according to the average of the original signal of the adjacent pixel group to become the corresponding lookup table bright state signal and the lookup table dark state signal. Hence, the first row original gray scale signal of the pixel groups are utilized to interpolate and calculate the adjusted original gray scale signal of the second row of the pixel groups. The interpolation technique first obtains the average of the original gray scale signal of the subpixels of the pixel group and the original gray scale signal of the subpixels of the adjacent pixel group and assigns the average value to be the adjusted original gray scale signal of the subpixel. Subsequently, the adjusted original gray scale signal is utilized to obtain the corresponding lookup table bright state signal or the lookup table dark state signal.

The application of the fourth driving mode to the second embodiment is the combination of the second driving mode and the third driving mode described above. Hence, in addition to utilizing the third driving mode to obtain the average value of the adjusted original gray scale signal of the second row subpixels via interpolation, the second driving mode is utilized to adjust the dark state output signal. The actual dark state output signal output to the subpixels of a particular color is the average of the corresponding lookup table dark state signals of two identical subpixels of the adjacent subpixels.

The application of the fifth driving mode to the second embodiment is an extension of the third driving mode described above. The interpolation technique of the third driving mode is used to calculate the average of the original signal of the subpixel at the first row, third column of a given pixel and the original signal of the pixel group adjacent the third column, in addition to obtaining the average for the second row subpixels of the pixel groups. Subsequently, the obtained average is utilized as an adjusted gray scale signal to correspond to the bright state or dark state signal group for obtaining the bright state or dark state output signal of each corresponding subpixel. In other words, according to the fifth driving mode, the interpolation region includes the subpixels of the second row, and first row, third column of each pixel group.

The application of the sixth driving mode to the second embodiment is the combination of the second driving mode and the fifth driving mode, in which the second driving mode involves the process of the dark state output signal and the fifth driving mode involves the process of the range of adjusted original gray scale signal. Hence, the interpolation method of the fifth driving mode is first utilized to obtain the average of the adjusted original gray scale signal of the subpixels of the second row and first row of third column of the pixel groups, and the second driving mode is utilized to obtain the average of the dark state output signals.

The application of the seventh driving mode to the second embodiment is an extension of the fifth driving mode. The seventh driving mode utilizes the subpixel region of the interpolation method, in which the subpixels of the second row, first row of third column, and first of second column of the pixel groups are included. Additionally, different weight factors are utilized according to the distance between each subpixel and non-interpolated subpixel (hence original spot) of the pixel group to calculate the interpolated value of each subpixel and adjust the gray scale signals.

The application of the eighth driving mode to the second embodiment is the combination of the second driving mode and the seventh driving mode. Hence, the interpolation method of the fifth driving mode is first utilized to obtain the average of the adjusted original gray scale signal of the subpixels of the second row, first row of third column, and first row of second column of the pixel groups, and the second driving mode is utilized to adjust the dark state output signal. Furthermore, the actual dark state output signal output to the subpixels of a particular color is the average of the corresponding lookup table dark state signals of two identical subpixels of the adjacent subpixels.

The difference between the application of the eighth driving mode to the second embodiment and the application of the eighth driving mode to the first embodiment lies in the different arrangement of the subpixels and different arrangement of the bright state signal or dark state signal of the subpixels. In addition, since the green subpixels driven by the green dark state signal in the second embodiment are not adjacent to the green subpixel of the adjacent pixel group, the utilization of the second driving mode to process the dark state output signal for obtaining an average value only applies to the blue subpixels driven by blue dark state signals.

By utilizing different subpixel arrangements and driving of bright state signal and dark state signal according to different driving modes, a smooth balance is obtained between the actual bright state or dark state signal output to the subpixels and the actual dark state or dark state signal of the subpixels of the adjacent pixel group. As a result, no abrupt color transformation will appear on the subpixels of the adjacent pixel groups and much smoother images can be obtained.

The arrangement of the pixel groups is not limited to the ones described in the first embodiment or the second embodiment, in which the first pixel group 31 of the first embodiment shown in FIG. 7 can be moved one column toward the right, such that the new first pixel group will include: the third red subpixel 313, the fourth red subpixel 314, the fifth blue subpixel 315, and the sixth red subpixel 316 of the old first pixel group 31, and the first green subpixel 321 and the second green subpixel 322 of the old second pixel group 32.

Alternatively, the first pixel group 31 can be moved two columns toward the right, such that the new first pixel group will include: the fourth red subpixel 314 and the sixth red subpixel 316 of the old first pixel group 31, and the first green subpixel 321, the second green subpixel 322, the third red subpixel 323, and the fifth blue subpixel 315 of the old second pixel group 32. Moreover, the first pixel group 31 can be moved down one column, such that the new first pixel group will include part of the subpixel of the old first pixel group 31 and part of the subpixel of the old fourth pixel group 34, such as the range of the pixel group described by the previous embodiments. The pixel group of the present invention includes at least three color pixels, in which each color pixel includes at least two subpixels, in which the arrangement of the subpixels will change according to different ranges.

The color display according to some embodiments includes: a plurality of first pixel groups and a plurality of second pixel groups, in which each first pixel group includes three color pixels, each color pixel including at least two subpixels, and the subpixels are arranged according to a first arrangement. The second pixel groups are alternately disposed with the first pixel groups along at least one axis, each of the second pixel groups including three color pixels, each color pixel including at least two subpixels, and the subpixels are arranged according to the second arrangement, in which the second arrangement mode is different from the first arrangement mode. In the above embodiments, the second pixel groups are alternately disposed with the first pixel groups along the x-axis direction; however, along the y-axis direction, the second pixel groups are not alternately disposed with the first pixel groups.

The first subpixel and the second subpixel within the first pixel group and the second pixel group are disposed adjacent to each other according to a first direction, the third subpixel and the fifth subpixel are adjacently disposed, the fourth subpixel and the sixth subpixel are adjacently disposed, either one of the first subpixel or the second subpixel is disposed adjacent to the fifth subpixel according to a second direction, in which the second direction is different from the first direction, the fifth subpixel and the sixth subpixel within the first pixel group are disposed according to a third direction, in which the third direction is different from the first direction and the second direction, and the fifth subpixel and the sixth subpixel within the second pixel group are disposed according to a fourth direction, in which the fourth direction is different from the first direction, the second direction, and the third direction.

As shown in FIG. 16, the first subpixel 511 and the second subpixel 512 of the first pixel group 51 are adjacently disposed in a horizontal direction, hence the first direction is horizontal. The second subpixel 512 and the fifth subpixel 515 are adjacently disposed in a vertical direction, hence the second direction is vertical. Additionally, the fifth subpixel 515 and the sixth subpixel 516 of the first pixel group 51 are disposed in an upper right direction, which is the third direction, and the fifth subpixel 525 and the sixth subpixel 526 of the second pixel group 52 are disposed in a lower right direction, which is the fourth direction.

According to the arrangement described above, the first subpixel of the first color pixel is driven by a first color dark state output signal, the second subpixel of the first color pixel is driven by a first color bright state output signal, the third subpixel and the fourth subpixel of the second color pixel are driven by a second color output signal, the fifth subpixel of the third color pixel is driven by a third color bright state output signal, and the sixth subpixel of the third color pixel is driven by a third color dark state output signal.

Additionally, the subpixels of the first pixel group are driven by a first signal group, the subpixels of the second pixel group are driven by a second signal group, in which the second signal group is different from the first signal group. The first signal group and the second signal group both includes at least a bright state signal group and at least a dark state signal group, in which the bright state signal group includes a plurality of bright state signals corresponding to different color pixels and the dark state signal group includes a plurality of dark state signals corresponding to different colors.

The bright state signals and the dark state signals are selected by a plurality of original signals of corresponding colors, in which the selected bright state signals of corresponding colors are combined with the selected dark state signals of corresponding colors to form the original signal of corresponding colors.

The normalized transmittance difference between front view and side view of the selected bright state signals and selected dark state signals of corresponding colors is less than the normalized transmittance difference between front view and side view of the original signal. Additionally, the selected bright state signals and dark state signals also allow users to obtain equal amount of brightness as the original signals and improve color distortion of the color display.

While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A color display comprising:

a plurality of first pixel groups, wherein each first pixel group comprises three color pixels, each color pixel comprises at least two subpixels, and the subpixels of each first pixel group having a first arrangement; and a plurality of second pixel groups, wherein each second pixel group comprises three color pixels, each color pixel comprises at least two subpixels, and the subpixels of each second pixel group having a second arrangement, wherein the first arrangement is different from the second arrangement, wherein each of the first pixel groups and the second pixel groups comprise a first color pixel, a second color pixel, and a third color pixel, wherein the first color pixel comprises a first subpixel and a second subpixel, the second color pixel comprises a third subpixel and a fourth subpixel, and the third color pixel comprises a fifth subpixel and a sixth subpixel, wherein the first subpixel of the first color pixel is driven by a first color dark state output signal, the second subpixel of the first color pixel is driven by a first color bright state output signal, the third subpixel and the fourth subpixel of the second color pixel is driven by a second color output signal, the fifth subpixel of the third color pixel is driven by a third color bright state output signal, and the sixth subpixel of the third color pixel is driven by a third color dark state output signal, wherein the first subpixel in each first pixel group driven by the first color dark state output signal is in a different row than the first subpixel in each second pixel group driven by the first color dark state output signal.

2. The color display of claim 1, wherein the first and second pixel groups are alternately arranged in at least one direction of the display.

3. A color display comprising:

a plurality of first pixel groups, wherein each first pixel group comprises three color pixels, each color pixel comprises at least two subpixels, and the subpixels of each first pixel group having a first arrangement; and a plurality of second pixel groups, wherein each second pixel group comprises three color pixels, each color pixel comprises at least two subpixels, and the subpixels of each second pixel group having a second arrangement, wherein the first arrangement is different from the second arrangement, wherein each of the first pixel groups and the second pixel groups comprise a first color pixel, a second color pixel, and a third color pixel, wherein the first color pixel comprises a first subpixel and a second subpixel, the second color pixel comprises a third subpixel and a fourth subpixel, and the third color pixel comprises a fifth subpixel and a sixth subpixel, wherein in each of the first and second pixel groups, the first subpixel and the second subpixel are adjacently disposed in a first direction, the third subpixel and the fifth subpixel are adjacently disposed in the first direction, either one of the first subpixel or the second subpixel is disposed adjacent to the fifth subpixel in a second direction, wherein the second direction is different from the first direction, the fifth subpixel and the sixth subpixel of the first pixel group are disposed in a third direction, wherein the third direction is different from the first direction and the second direction, and the fifth subpixel and the sixth pixel of the second pixel group are disposed in a fourth direction wherein the fourth direction is different from the first direction, the second direction, and the third direction, wherein the first color pixel is a green pixel, the second color pixel is a red pixel, and the third color pixel is a blue pixel, wherein the subpixels of each of the first pixel groups and the second pixel groups are arranged in a matrix comprising two rows and three columns, wherein the first subpixel and the second subpixel are disposed in the first column, the third subpixel and the fifth subpixel are disposed in the second column, and the fourth pixel and the sixth pixel are disposed in the third column.

4. The color display of claim 3, wherein the first direction is horizontal, the second direction is vertical, the third direction is a first slanted direction, and the fourth direction is a second slanted direction.

5. The color display of claim 3, wherein the first arrangement of the first pixel group comprises:

the first subpixel of the first pixel group disposed in the first row and first column of the first pixel group;

the second subpixel of the first pixel group disposed in the second row and first column of the first pixel group;

the third subpixel of the first pixel group disposed in the first row and second column of the first pixel group;

the fifth subpixel of the first pixel group disposed in the second row and second column of the first pixel group;

the fourth subpixel of the first pixel group disposed in the second row and third column of the first pixel group; and the sixth subpixel of the first pixel group disposed in the first row and third column of the first pixel group; and the second arrangement of the second pixel group comprises:

the first subpixel of the second pixel group disposed in the first row and first column of the second pixel group;

the second subpixel of the second pixel group disposed in the second row and first column of the second pixel group;

the third subpixel of the second pixel group disposed in the second row and second column of the second pixel group;

the fifth subpixel of the second pixel group disposed in the first row and second column of the second pixel group;

the fourth subpixel of the second pixel group disposed in the first row and third column of the second pixel group; and the sixth subpixel of the second pixel group disposed in the second row and third column of the second pixel group.

6. The color display of claim 5, wherein the first subpixel of each first pixel group is driven by a first green dark state output signal, the second subpixel of the first pixel group is driven by a first green bright state output signal, the third subpixel and the fourth subpixel of the first pixel group are driven by red output signals, the fifth subpixel of the first pixel group is driven by a first blue bright state output signal, the sixth subpixel of the first pixel group is driven by a first blue dark state output signal; and the first subpixel of each second pixel group is driven by a second green bright state output signal, the second subpixel of the second pixel group is driven by a second green dark state output signal, the third subpixel and the fourth subpixel of the second pixel group are driven by red output signals, the fifth subpixel of the second pixel group is driven by a second blue bright state output signal, and the sixth subpixel of the second pixel group is driven by a second blue dark state output signal.

7. The color display of claim 6 further comprising, at least one lookup table, wherein the at least lookup table comprises an original gray scale signal group, a bright state signal group, and a dark state signal group, wherein the bright state signal group comprises a plurality of lookup table bright state signals and the dark state signal group comprises a plurality of lookup table dark state signals.

8. The color display of claim 6, wherein the bright state output signals are obtained from the corresponding lookup table bright state signals of the bright state signal group and the dark state output signals are obtained from the corresponding lookup table dark state signals of the dark state signal group.

9. The color display of claim 7, wherein each of at least some of the dark state output signals is an average of the lookup table dark state signals corresponding to subpixels of two adjacent pixel groups.

10. The color display of claim 7, wherein each subpixel of the pixel groups is associated with an original gray scale signal, the second row subpixels of each pixel group are associated with corresponding adjusted original gray scale signals, and each adjusted original gray scale signal is the average of the original gray scale signal of the second row subpixel of each pixel group and the original gray scale signal of the subpixel of the adjacent pixel group, wherein the lookup table bright state signal or the lookup table dark state signal is obtained by mapping the adjusted original gray scale signal to the bright state output signal or dark state output signal.

11. The color display of claim 7, wherein each subpixel of the pixel groups is associated with an original gray scale signal, the second row subpixels of each pixel group is associated with corresponding adjusted original gray scale signals, each adjusted original gray scale signal is the average of the original gray scale signal of the corresponding second row subpixel of each pixel group and the original gray scale signal of the subpixel of the adjacent pixel group, wherein a lookup table bright state signal or the lookup table dark state signal is obtained by mapping the adjusted original gray scale signal, wherein the bright state output signals of the subpixels in the second row are equal to the corresponding lookup table bright state signal, and the dark state output signals of the subpixels in the second row are the average of the lookup table dark state signal of the corresponding subpixel of the pixel group and the lookup table dark state signal of the subpixel of the adjacent pixel group.

12. The color display of claim 7, wherein each subpixel of the pixel groups is associated with an original gray scale signal, the subpixels of the second row and the first row, third column of each pixel group being associated with respective adjusted original gray scale signals, and each adjusted original gray scale signal is (1) the average of the original gray scale signal of the subpixel of the second row and the original gray scale signal of the pixel of the adjacent pixel group, or (2) the average of the original gray scale signal of the subpixel of the first row, third column and the original gray scale signal of the pixel group adjacent the third column, wherein a lookup table bright state signal or lookup table dark state signal is obtained by mapping the adjusted original gray scale signal for forming the bright state output signal or dark state output signal of the subpixels.

13. The color display of claim 7, wherein each subpixel of the pixel groups is associated with an original gray scale signal, the subpixels of the second row and the first row, third column are associated with respective adjusted original gray scale signals, each adjusted original gray scale signal is (1) the average of original gray scale signal of the respective subpixel of the second row and the original gray scale signal of the pixel of the adjacent pixel group, or (2) the average of the original gray scale signal of the subpixel at the first row, third column and the original gray scale signal of the adjacent pixel group, wherein a lookup table bright state signal or lookup table dark state signal is obtained by mapping the adjusted original gray scale signal, the bright state output signals of the subpixels in the second row being equal to corresponding lookup table bright state signals, and the dark state output signals of at least some subpixels in the first row, third column of the pixel groups being the average of the lookup table dark state signals of the subpixels of the pixel group and the lookup table dark state signals of the subpixels of the adjacent pixel group.

14. The color display of claim 7, wherein each subpixel of the pixel groups is associated with an original gray scale signal, the subpixels of the second row, the first row, third column, and the first row, second column are associated with adjusted original gray scale signals, each adjusted gray scale signal is the average of the original gray scale signal of the respective subpixel at (1) the second row, (2) the first row, third column, or (3) the first row, second column of the pixel group, and the original gray scale signal of the pixel of the adjacent pixel group, wherein a lookup table bright state signal or lookup table dark state signal is obtained by mapping the adjusted original gray scale signal for forming the bright state output signal or dark state output signal of the subpixels.

15. The color display of claim 7, wherein each subpixel of the pixel groups is associated with an original gray scale signal, the subpixels of the second row, the first row, third column, and the first row, second column are associated with adjusted original gray scale signals, each adjusted gray scale signal being the average of the original gray scale signal of a respective subpixel at (1) the second row, (2) the first row, third column, or (3) the first row, second column of the pixel group, and the original gray scale signal of the pixel of the adjacent pixel group, wherein a lookup table bright state signal or the lookup table dark state signal is obtained by mapping the adjusted original gray scale signal, the bright state output signal of at least some of the subpixels being equal to the lookup table bright state signal, and the dark state output signal of at least some of the subpixels being the average of the lookup table dark state signal of the subpixel of the pixel group and the lookup table dark state signal of the subpixel of the adjacent pixel group.

16. The color display of claim 3, wherein the first direction is vertical, the second direction is horizontal, the third direction is a first slanted direction, and the fourth direction is a second slanted direction.

17. A color display comprising:

a plurality of first pixel groups, wherein each first pixel group comprises three color pixels, each color pixel comprises at least two subpixels, and the subpixels of each first pixel group having a first arrangement; and a plurality of second pixel groups, wherein each second pixel group comprises three color pixels, each color pixel comprises at least two subpixels, and the subpixels of each second pixel group having a second arrangement, wherein the first arrangement is different from the second arrangement, wherein each of the first pixel groups and the second pixel groups comprise a first color pixel, a second color pixel, and a third color pixel, wherein the first color pixel comprises a first subpixel and a second subpixel, the second color pixel comprises a third subpixel and a fourth subpixel, and the third color pixel comprises a fifth subpixel and a sixth subpixel, wherein in each of the first and second pixel groups, the first subpixel and the second subpixel are adjacently disposed in a first direction, the third subpixel and the fifth subpixel are adjacently disposed in the first direction, either one of the first subpixel or the second subpixel is disposed adjacent to the fifth subpixel in a second direction, wherein the second direction is different from the first direction, the fifth subpixel and the sixth subpixel of the first pixel group are disposed in a third direction, wherein the third direction is different from the first direction and the second direction, and the fifth subpixel and the sixth pixel of the second pixel group are disposed in a fourth direction wherein the fourth direction is different from the first direction, the second direction, and the third direction, wherein the subpixels of the first pixel group and the second pixel group are arranged in a matrix of two rows and three columns, the first subpixel and the third subpixel are disposed in the first column, the second subpixel and the fifth subpixel are disposed in the second column, and the fourth subpixel and the sixth subpixel are disposed in the third column, wherein the first arrangement of the first pixel group comprises:

the first subpixel of the first pixel group disposed in the first row and first column of the first pixel group;

the third subpixel of the first pixel group disposed in the second row and first column of the first pixel group;

the second subpixel of the first pixel group disposed in the first row and second column of the first pixel group;

the fifth subpixel of the first pixel group disposed in the second row and second column of the first pixel group;

the sixth subpixel of the first pixel group disposed in the first row and third column of the first pixel group; and the fourth subpixel of the first pixel group disposed in the second row and third column of the first pixel group; and the second arrangement of the second pixel group comprises:

the first subpixel of the second pixel group disposed in the second row and first column of the second pixel group;

the third subpixel of the second pixel group disposed in the first row and first column of the second pixel group;

the second subpixel of the second pixel group disposed in the second row and second column of the second pixel group;

the fifth subpixel of the second pixel group disposed in the first row and second column of the second pixel group;

the sixth subpixel of the second pixel group disposed in the second row and third column of the second pixel group; and the fourth subpixel of the second pixel group disposed in the first row and third column of the second pixel group.

18. The color display of claim 17, wherein the first subpixel of the first pixel group is driven by a first green dark state output signal, the second subpixel of the first pixel group is driven by a first green bright state output signal, the third subpixel and the fourth subpixel of the first pixel group are driven by a first red output signal, the fifth subpixel of the first pixel group is driven by a first blue bright state output signal, the sixth subpixel of the first pixel group is driven by a first blue dark state output signal; and the first subpixel of the second pixel group is driven by a second green dark state output signal, the second subpixel of the second pixel group is driven by a second green bright state output signal, the third subpixel and the fourth subpixel of the second pixel group are driven by a second red output signal, the fifth subpixel of the second pixel group is driven by a second blue bright state output signal, and the sixth subpixel of the second pixel group is driven by a second blue dark state output signal.

19. The color display of claim 17, wherein the first subpixel of the first pixel group is driven by a first green dark state output signal, the second subpixel of the first pixel group is driven by a first green bright state output signal, the third subpixel and the fourth subpixel of the first pixel group are driven by a first red output signal, the fifth subpixel of the first pixel group is driven by a first blue dark state output signal, the sixth subpixel of the first pixel group is driven by a first blue bright state output signal; and the first subpixel of the second pixel group is driven by a second green dark state output signal, the second subpixel of the second pixel group is driven by a second green bright state output signal, the third subpixel and the fourth subpixel of the second pixel group are driven by a second red output signal, the fifth subpixel of the second pixel group is driven by a second blue dark state output signal, and the sixth subpixel of the second pixel group is driven by a second blue bright state output signal.

20. The color display of claim 18, further comprising a lookup table, wherein the lookup table comprises an original gray scale signal group, a bright state signal group, and a dark state signal group, wherein the bright state signal group comprises a plurality of lookup table bright state signals and the dark state signal group comprises a plurality of lookup table dark state signals.

21. The color display of claim 20, wherein the bright state output signals are obtained from the corresponding lookup table bright state signals of the bright state signal group and the dark state output signals are obtained from the corresponding lookup table dark state signals of the dark state signal group.

22. The color display of claim 20, wherein each of the dark state output signals is an average of the lookup table dark state signals corresponding to the subpixels of two adjacent pixel groups.

23. The color display of claim 20, wherein each subpixel of the pixel groups is associated with an original gray scale signal, the second row subpixels of each pixel group are associated with adjusted original gray scale signals, and each adjusted original gray scale signal is an average of the original gray scale signal of a respective second row subpixel of each pixel group and the original gray scale signal of the subpixel of the adjacent pixel group, wherein a lookup table bright state signal or the lookup table dark state signal is obtained by mapping to the adjusted original gray scale signal for forming the bright state output signal or dark state output signal of the subpixels.

24. The color display of claim 20, wherein each subpixel of the pixel groups is associated with an original gray scale signal, the second row subpixels of each pixel group are associated with adjusted original gray scale signals, each adjusted original gray scale signal is an average of the original gray scale signal of a respective second row subpixel of each pixel group and the original gray scale signal of the subpixel of the adjacent pixel group, wherein a lookup table bright state signal or the lookup table dark state signal is obtained by mapping the respective adjusted original gray scale signal, the bright state output signal of at least some of the subpixels being equal to the lookup table bright state signals, and the dark state output signal of each of at least some of the subpixels is the average of the respective lookup table dark state signal of the subpixel of the pixel group and each of at least some of the subpixels is the lookup table dark state signal of the subpixel of the adjacent pixel group.

25. The color display of claim 20, wherein each subpixel of the pixel groups is associated with an original gray scale signal, the subpixels of the second row and the first row, third column are associated with respective adjusted original gray scale signals, and each adjusted original gray scale signal is the average of the original gray scale signal of the respective subpixel of (1) the second row and or (2) first row, third column of the pixel group and the original gray scale signal of the pixel of the adjacent pixel group, wherein a lookup table bright state signal or the lookup table dark state signal is obtained by mapping the respective adjusted original gray scale signal for forming the bright state output signal or dark state output signal of the subpixels.

26. The color display of claim 20, wherein each subpixel of the pixel groups is associated with an original gray scale signal, the subpixels of the second row and the first row, third column being associated with adjusted original gray scale signals, each adjusted original gray scale signal is an average of the original gray scale signal of a respective subpixel of (1) the second row or (2) first row, third column of the pixel group, and the original gray scale signal of the pixel of the adjacent pixel group, wherein a lookup table bright state signal or lookup table dark state signal is obtained by mapping the respective adjusted original gray scale signal, the bright state output signals of the subpixels being equal to respective lookup table bright state signals, and each dark state output signal of at least some of the subpixels being the average of the lookup table dark state signal of the respective subpixel of the pixel group and the lookup table dark state signal of the subpixel of the adjacent pixel group.

27. The color display of claim 20, wherein each subpixel of the pixel groups is associated with an original gray scale signal, the subpixels of the second row, the first row, third column, and the first row, second column are associated with respective adjusted original gray scale signals, each adjusted gray scale signal is an average of the original gray scale signal of a respective subpixel of (1) the second row, the first row, third column, or (3) the first row, second column of the pixel group, and the original gray scale signal of the pixel of the adjacent pixel group, wherein the lookup table bright state signal or lookup table dark state signal is obtained by mapping the respective adjusted original gray scale signal for forming the bright state output signal or dark state output signal of the subpixels.

28. The color display of claim 20, wherein each subpixel of the pixel groups is associated with an original gray scale signal, the subpixels of the second row, the first row, third column, and the first row, second column are associated with adjusted original gray scale signals, each adjusted gray scale signal is an average of the original gray scale signal of a respective subpixel of (1) the second row, (2) the first row, third column, or (3) the first row, second column of the pixel group, and the original gray scale signal of the pixel of the adjacent pixel group, wherein a lookup table bright state signal or lookup table dark state signal is obtained by mapping the respective adjusted original gray scale signal, the bright state output signals of at least some of the subpixels being equal to respective lookup table bright state signals, and each dark state output signal of at least some of the subpixels is an average of the lookup table dark state signal of the respective subpixel of the pixel group and the lookup table dark state signal of the subpixel of the adjacent pixel group.

29. A signal processing system of a color display, wherein the signal processing system is to transmit display signals to a driver, the signal processing system comprising:

a first lookup table, wherein the first lookup table is to output a bright state signal according to a raw data;

a second lookup table, wherein the second lookup table is to output a dark state signal according to the raw data; and a data selector connected to the first lookup table and the second lookup table, wherein the data selector is to choose either one of the bright state signal or the dark state signal as an input signal for transmission to the driver, wherein the driver is to provide data to an array of pixels comprising:

a plurality of first pixel groups, wherein each first pixel group comprises three color pixels, each color pixel comprises at least two subpixels, and the subpixels of each first pixel group having a first arrangement; and a plurality of second pixel groups, wherein each second pixel group comprises three color pixels, each color pixel comprises at least two subpixels, and the subpixels of each second pixel group having a second arrangement, wherein the first arrangement is different from the second arrangement, wherein each of the first pixel groups and the second pixel groups comprise a first color pixel, a second color pixel, and a third color pixel, wherein the first color pixel comprises a first subpixel and a second subpixel, the second color pixel comprises a third subpixel and a fourth subpixel, and the third color pixel comprises a fifth subpixel and a sixth subpixel, wherein the first subpixel of the first color pixel is driven by a first color dark state output signal, the second subpixel of the first color pixel is driven by a first color bright state output signal, wherein the first subpixel in each first pixel group driven by the first color dark state output signal is in a different row than the first subpixel in each second pixel group driven by the first color dark state output signal.

30. The signal processing system of claim 29 further comprising:

a controller connected to the data selector for receiving input signal and transmitting the input signal to the driver.

31. A color display comprising:

a plurality of first pixel groups, each first pixel group having three color pixels and each color pixel comprising at least two subpixels, wherein each first pixel group has a first arrangement of subpixels, and the subpixels of the first pixel group are driven by a first signal group; and a plurality of second pixel groups alternately disposed with the first pixel groups, each second pixel group having three color pixels and each color pixel comprising at least two subpixels, wherein each second pixel group has a second arrangement of subpixels, wherein the second arrangement being different from the first arrangement, and the subpixels of the second pixel group are driven by a second signal group, wherein the three color pixels of each of the first and second pixel groups comprise a first color pixel having first and second subpixels, a second color pixel having third and fourth subpixels, and a third color pixel having fifth and sixth subpixels, wherein in each of the first and second pixel groups, the first subpixel and the second subpixel are adjacently disposed along a first axis, the third subpixel and the fifth subpixel are adjacently disposed along the first axis, either one of the first subpixel or the second subpixel is disposed adjacent to the fifth subpixel along a second axis, wherein the second axis is different from the first axis, the fifth subpixel and the sixth subpixel of the first pixel group are disposed along a third axis, wherein the third axis is different from the first axis and the second axis, and the fifth subpixel and the sixth pixel of the second pixel group are disposed along a fourth axis, wherein the fourth axis is different from the first axis, the second axis, and the third axis.

32. The color display of claim 31, wherein the first signal group comprises at least a bright state signal group and at least a dark state signal group, wherein the bright state signal group comprises a plurality of bright state signals to drive corresponding subpixels in each first pixel group and the dark state signal group comprises a plurality of dark state signals to drive corresponding subpixels in each second pixel group.

33. The color display of claim 32, wherein each bright state signal and the dark state signal is selected according to a respective original display signal of a corresponding pixel, wherein a bright state signal of the corresponding pixel and a dark state signal of the corresponding pixel are combined to form the original signal of the corresponding pixel.

34. The color display of claim 31, wherein the second signal group comprises at least a bright state signal group and at least a dark state signal group, wherein the bright state signal group comprises a plurality of bright state signals to drive corresponding subpixels in the second pixel group, and the dark state signal group comprises a plurality of dark state signals to drive corresponding subpixels in the second pixel group.

* * * * *